US009248321B2

(12) United States Patent
Nam et al.

(10) Patent No.: US 9,248,321 B2
(45) Date of Patent: Feb. 2, 2016

(54) FIRE EVACUATION INSTALLATION

(75) Inventors: Jung-O Nam, Gyeongsangbuk-do (KR); Se-Hong Min, Seoul (KR)

(73) Assignee: E&F TECH CO., LTD, Gyeonggi-Do (KR)

( * ) Notice: Subject to any disclaimer, the term of this patent is extended or adjusted under 35 U.S.C. 154(b) by 0 days.

(21) Appl. No.: 14/128,489

(22) PCT Filed: Apr. 20, 2012

(86) PCT No.: PCT/KR2012/003086

§ 371 (c)(1),
(2), (4) Date: Dec. 20, 2013

(87) PCT Pub. No.: WO2012/176976

PCT Pub. Date: Dec. 27, 2012

(65) Prior Publication Data

US 2014/0123570 A1 May 8, 2014

(30) Foreign Application Priority Data

Jun. 22, 2011 (KR) ..... 10-2011-0060457

(51) Int. Cl.

| | |
|---|---|
| ***E04F 11/06*** | (2006.01) |
| ***A62B 3/00*** | (2006.01) |
| ***E04H 1/12*** | (2006.01) |
| ***E04H 9/00*** | (2006.01) |

(52) U.S. Cl.

CPC ..... *A62B 3/00* (2013.01); *E04H 1/1261* (2013.01); *E04H 9/00* (2013.01)

(58) Field of Classification Search

CPC ..... E04F 11/06; A62B 5/00; E04B 1/3442; E04B 1/3445; E04B 1/344; E04B 1/34384

USPC ..... 52/173.1, 64–67, 69–71, 73–74, 79.1, 52/79.2, 79.5, 79.6, 79.7, 79.8, 79.9, 52/79.12, 79.13; 182/48–49, 70, 82–83, 182/84 X, 85; 135/121, 143

See application file for complete search history.

(56) References Cited

U.S. PATENT DOCUMENTS

| | | | | | |
|---|---|---|---|---|---|
| 277,049 | A | * | 5/1883 | Mickey | 182/18 |
| 1,448,235 | A | * | 3/1923 | Read | 52/73 |
| 2,709,030 | A | * | 5/1955 | Vroman et al. | 182/78 |
| 3,841,037 | A | * | 10/1974 | Clark | 52/36.2 |
| 3,984,949 | A | * | 10/1976 | Wahlquist | 52/70 |

(Continued)

FOREIGN PATENT DOCUMENTS

| | | |
|---|---|---|
| CN | 2070349 U | 1/1991 |
| KR | 10-0967563 B1 | 7/2010 |

(Continued)

*Primary Examiner* — Beth Stephan

(74) *Attorney, Agent, or Firm* — AKC Patents, LLC; Aliki K. Collins

(57) ABSTRACT

Disclosed is a fire evacuation installation. When evacuees are not able to evacuate through an emergency exit or other means of evacuation when a fire occurs, the fire evacuation installation may safely protect the evacuees from flames and poisonous gas until rescue workers arrive. Further, the fire evacuation installation may be prevented from being damaged by exposure to rain, and the fire evacuation installation may have an elegant outer appearance and be more easily installed. In addition, the fire evacuation installation may be selectively moved between the floors of a building.

23 Claims, 42 Drawing Sheets

(56) References Cited

U.S. PATENT DOCUMENTS

| | | | | | |
|---|---|---|---|---|---|
| 4,079,812 | A * | 3/1978 | Naka | 182/48 |
| 4,090,585 | A * | 5/1978 | Laub | 182/47 |
| 4,244,443 | A * | 1/1981 | Naka | 182/84 |
| 4,388,982 | A * | 6/1983 | Yonahara | 182/82 |
| 4,989,379 | A * | 2/1991 | Suzuki | 52/66 |
| 5,012,892 | A * | 5/1991 | Kelly | 182/84 |
| 5,103,934 | A * | 4/1992 | Brooks | 182/19 |
| 5,131,493 | A * | 7/1992 | Johansen | 182/84 |
| 5,377,778 | A * | 1/1995 | Lan | 182/48 |
| 5,927,025 | A * | 7/1999 | Brockman et al. | 52/173.2 |
| 6,467,221 | B1 * | 10/2002 | Bigelow | 52/2.17 |
| 6,578,664 | B1 * | 6/2003 | Doherty | 182/93 |
| 8,042,562 | B1 * | 10/2011 | McDaniel, Jr. | 135/97 |
| 2007/0187178 | A1 * | 8/2007 | Tellex | 182/84 |
| 2009/0014044 | A1 * | 1/2009 | Hartman et al. | 135/143 |
| 2009/0218167 | A1 * | 9/2009 | Lee | 182/142 |
| 2010/0269418 | A1 * | 10/2010 | Ahmedy | 52/71 |
| 2011/0138701 | A1 * | 6/2011 | Plumley | 52/79.5 |

FOREIGN PATENT DOCUMENTS

| | | | |
|---|---|---|---|
| KR | 10-2011-0019857 | A | 3/2011 |
| KR | 10-1036763 | B1 | 5/2011 |

* cited by examiner

FIRE EVACUATION INSTALLATION

CROSS-REFERENCE TO RELATED APPLICATION

This application claims the benefit of Korean Patent Application No. 10-2011-0060457, filed on Jun. 22, 2011 in the Korean Intellectual Property Office, the disclosure of which is incorporated herein by reference.

TECHNICAL FIELD

The present disclosure in one or more embodiments relates to an emergency evacuation installation against fire. More particularly, the present disclosure relates to an emergency evacuation installation for providing evacuees with a backup shelter when isolated from a vulnerable emergency exit or other means of evacuation until the arrival of rescue workers against firing or burning poisonous gas, while the evacuation installation is normally self-concealed resisting damages from rain and weather elements, swiftly attached, possessing an elegant external appearance, and is selectively movable between the floors of a building.

BACKGROUND

As the majority of the population is concentrated in cities, ever increasing number of high-rise buildings are erected for more and more people to live and work in a limited space.

For concern of human fatality in the high-rise buildings in case of fire, it has been stipulated to install emergency exits and fire doors, or a rappelling type descender or various other means have been provided as an alternative emergency escape, although a very small number of the prospective users might be familiar with the use of such contraption, setting aside how well they could actually follow the emergency maneuvering of the descender with fear.

Besides, the emergency exit, for example is where most people converge and is thus occasionally incapacitated. In addition, a fire door is typically installed at the emergency exit for preventing a flow of smoke and flames but it is often made to work only with the manual operation of a volunteer, which may happen rarely. In this case, the emergency exit tends to function as the smoke chimney, rather resulting in the spread of a fire. There have been reports of a substantial number of casualties that occurred due to the adverse effect of the fire door which exposes the victims unprotected to the flame and even more deadly poisonous gas.

The present applicant proposed a safe escape technology in Korean Patent Registration No. 10-099824-00000 Nov. 29, 2010 entitled "The installation to evacuating from a fire" with a box-type collapsible fixture placed on a veranda or balcony to allow isolated persons from an emergency exit to safely escape from flames and noxious fumes until rescuers arrive for help. However, such facilities may not be aesthetically pleasing as they are publically visible between occasional services, and they are susceptible to oxidation corrosions at various metallic panels and hinges in wet weather hampering the full durability.

In addition, there may be a difficulty for the general public to maneuver those facilities in the collapsing and expanding operations, and the suggested configurations could be regarded as structurally unstable.

DISCLOSURE

Technical Problem

Therefore, the present disclosure in one or more embodiments provides a self-concealed emergency evacuation installation which is adapted to visually blend in with the exterior of a building to improve aesthetic appearance thereof, prevent elements such as rainwater from seeping inside, provide a transit rescue pod for occupants when isolated from an emergency exit or other means of evacuation to escape from flames and noxious fumes until rescuers arrive for help, give the occupants a sense of structural stability, while the evacuation installation is swiftly installed movably between the floors of the building.

SUMMARY

The present emergency evacuation installation includes a frame, a rear panel, a couple of side panels, a bottom panel, a top panel and an emergency ladder.

The frame is fixed to the railing of the veranda having double entrance doors respectively hinged on both sides of the frame and each having a knob projecting forward and a pair of first ladder docking holes extending vertically through the frame and opening towards the upper surface of the frame. The rear panel has a rectangular shape and is disposed rearward of the frame and is provided with a flange formed by forward right-angled bending of the periphery of the rear panel with an exit door formed centrally of the rear panel. Each of the side panels includes first and second panels which are interconnected in an inwardly folding arrangement by a number of corresponding first hinges and each side panel is also connected at its front and rear ends by a number of second and third hinges foldably with the rear portion of the inside of the frame and one lateral end of the rear panel, respectively. The bottom panel has a lateral end attached to one or more of fourth hinges formed inside of a lower end portion of the frame, at least one air inlet hole with a closing and opening plate adjustably disposed thereover, a lower sliding door configured to be pushed sideways to slide open a predetermined portion of the bottom panel, and a pair of second ladder fixture holes extending through the bottom panel and located between the lower sliding door and the double entrance doors so that the bottom panel is expanded until it is stopped by a lower section of the flange of the rear panel to complete the floor surface as the emergency evacuation installation is deployed. The top panel has a lateral end attached to one or more of fifth hinges formed inside of an upper end portion of the frame and an upper sliding door configured to be pushed sideways to slide open a predetermined portion of the top panel, and engages, when deployed, a downward surface of an upper section of the flange. And the emergency ladder is installed inside of one of the double entrance doors and has upper hooks each bent into a forward curve terminated by a distal end which can be inserted in each of the second ladder fixture holes and foots which can be inserted in another pair of first ladder docking holes of a down stair emergency evacuation installation once the emergency evacuation installation is repeated in a column over the building.

Advantageous Effects

According to the present disclosure as described above, various components of the present emergency evacuation installation attached to the balcony are not exposed to the outside as the installation is neatly enclosed to blend in the exterior of a building while in constant readiness for deployment in case of emergency and thereby allows unhindered use thereof with a contribution to aesthetics of the building. Further, the emergency evacuation installation is configured to prevent damages and corrosions caused by rain and such elements by cutting off rainwater in particular, so as to relieve the concerns of possible accident due to damage of the parts.

In addition, the present emergency evacuation installation at the balcony of a building provides the occupants with a protected rescue pod to enter for evading flames and toxic gases to save casualties before rescue help arrives and usually folds flat with the minimal footprint to block field of vision. At the same time, the present installation with a sturdy fixed frame ensures the user to get a sense of structural and psychological stability. Further, the present installation has a bottom panel deployed by its own weight and the top panel that is deployed with the assistance of a hydraulic cylinder suspension into active service of the emergency evacuation installation with ease.

Moreover, the present emergency evacuation installation provides emergency ladders adapted to engage installations on lower floors when a floor-to-floor evacuation is available for the occupants to readily escape against inaccessibility to the fire door and emergency staircase to further reduce possible casualties.

Figure 1:
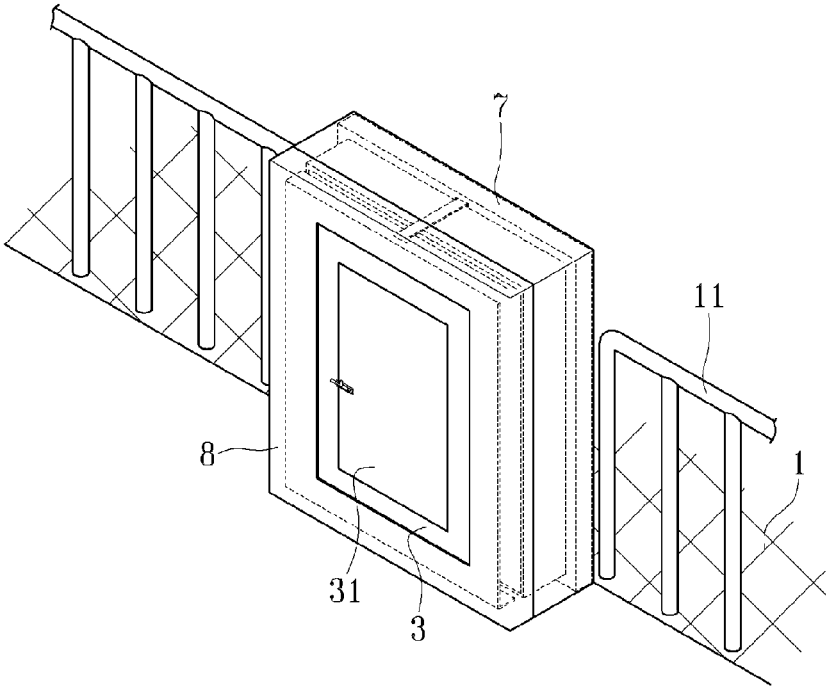
FIGS. 1 to 8 are diagrams of an emergency evacuation installation according to a first embodiment of the present disclosure.

| REFERENCE NUMERALS | |
|---|---|
| 1": Balcony/Veranda | 2": Frame |
| 3": Rear Panel | 4": Side Panel |
| 5": Bottom Panel | 6": Top Panel |
| 7": Emergency Ladder | 8": Locking Means |

DETAILED DESCRIPTION

Therefore, the following detailed description of some embodiments of the present disclosure with reference to the drawings will render those skilled in the art to readily understand and reproduce the exemplary configurations.

Figure 2:
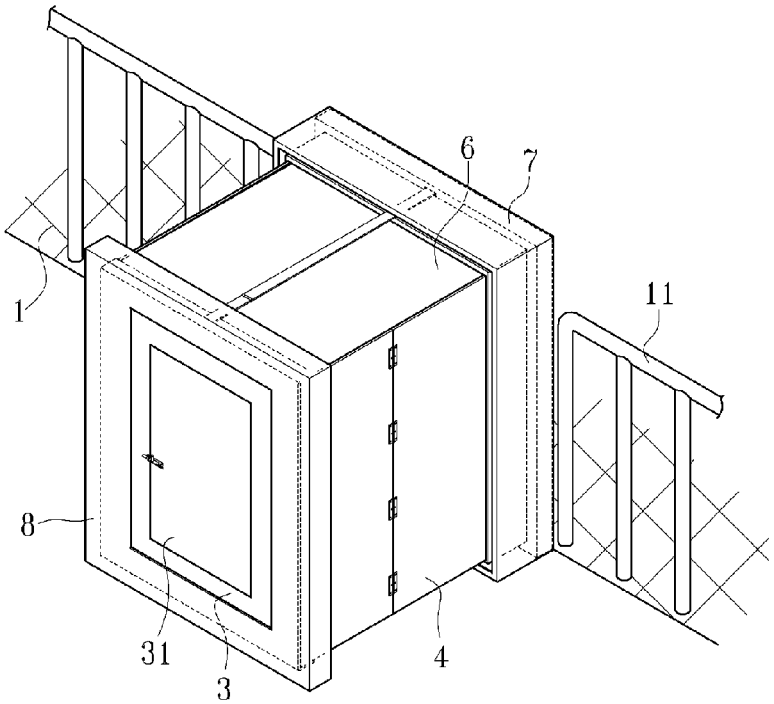
Figure 3:
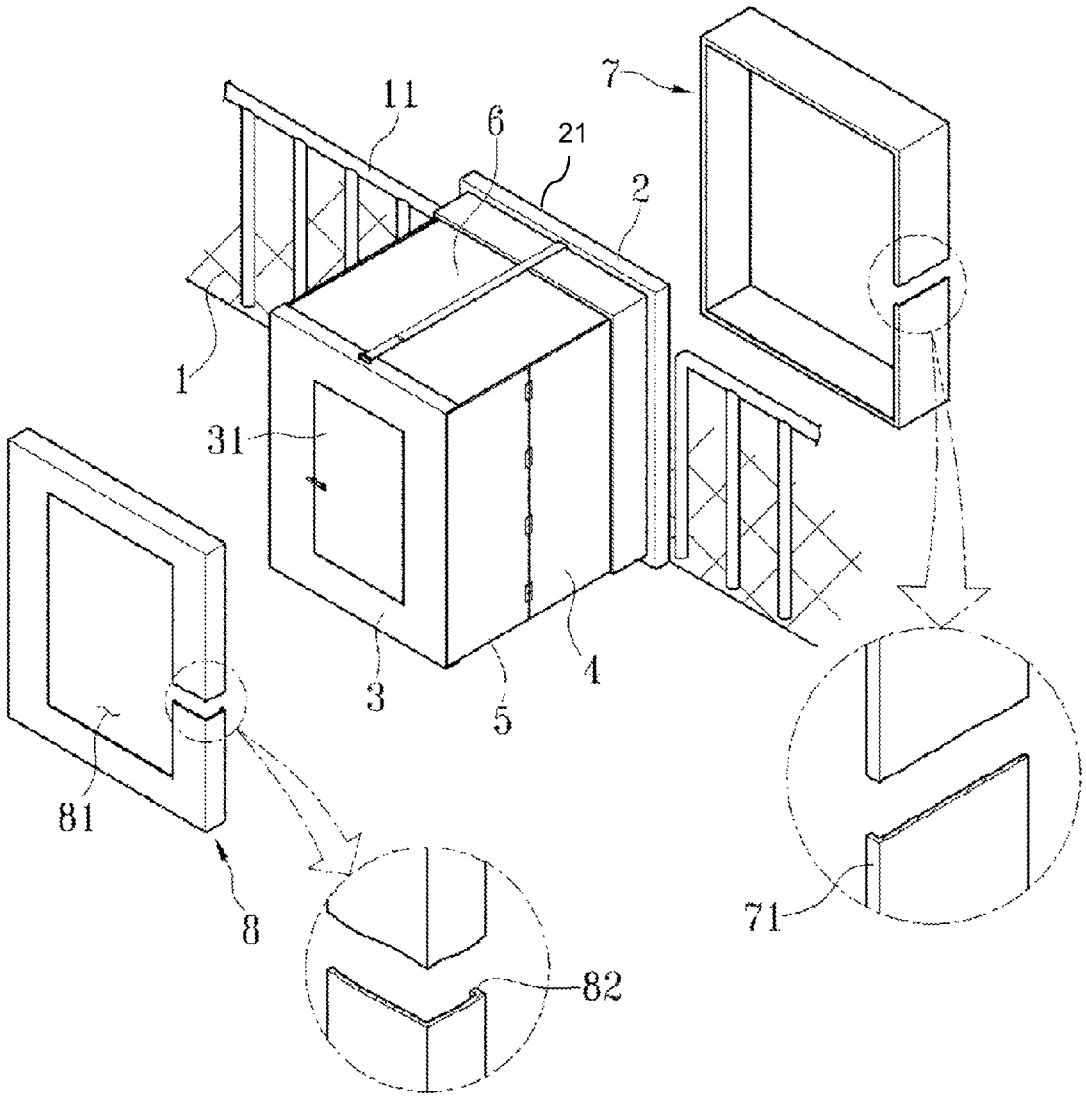
Figure 4:
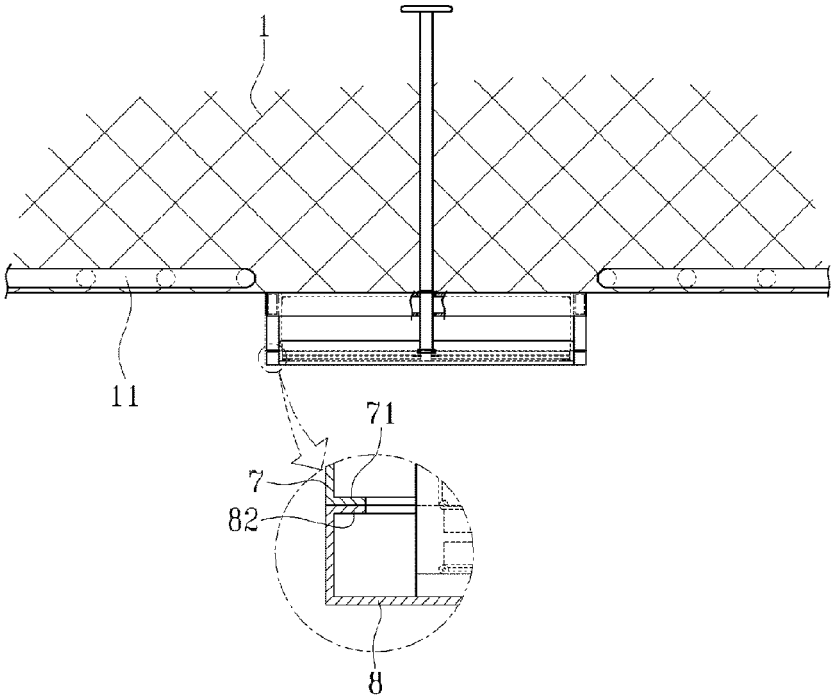
Figure 5:
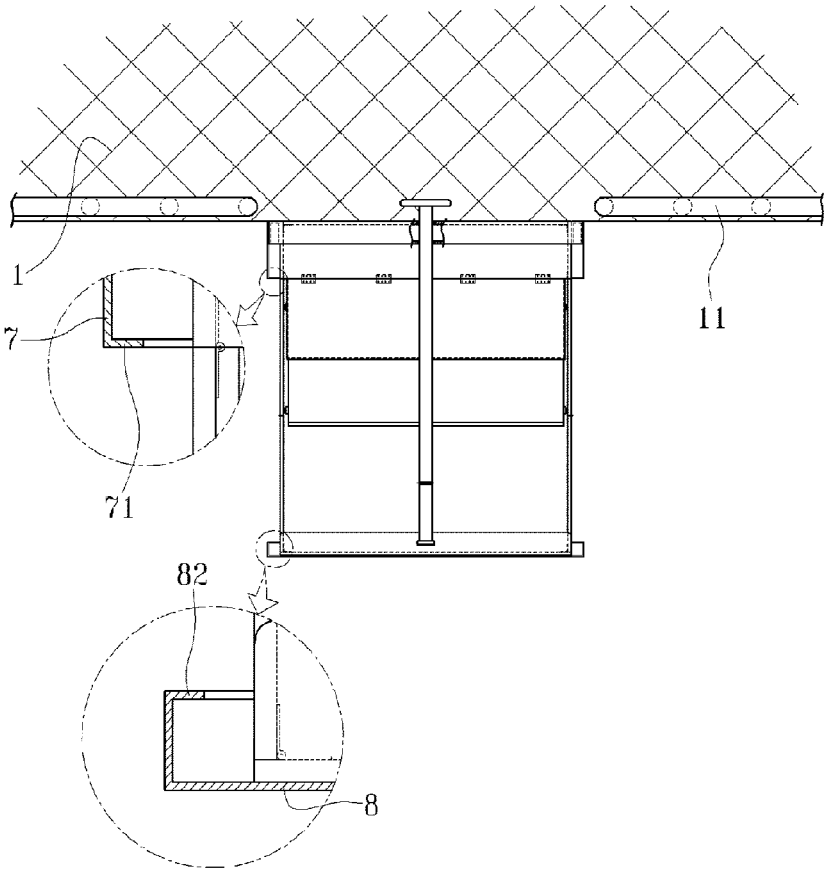

FIG. 1 is a perspective view of an emergency evacuation installation shown as collapsed according to some embodiments of the present disclosure, FIG. 2 is a perspective view of an expanded state thereof, FIG. 3 is an exploded perspective view, and FIG. 4 is a plan view of a collapsed state thereof. Finally, FIG. 5 is a plan view of the expanded state of the evacuation installation.

Figure 26A:
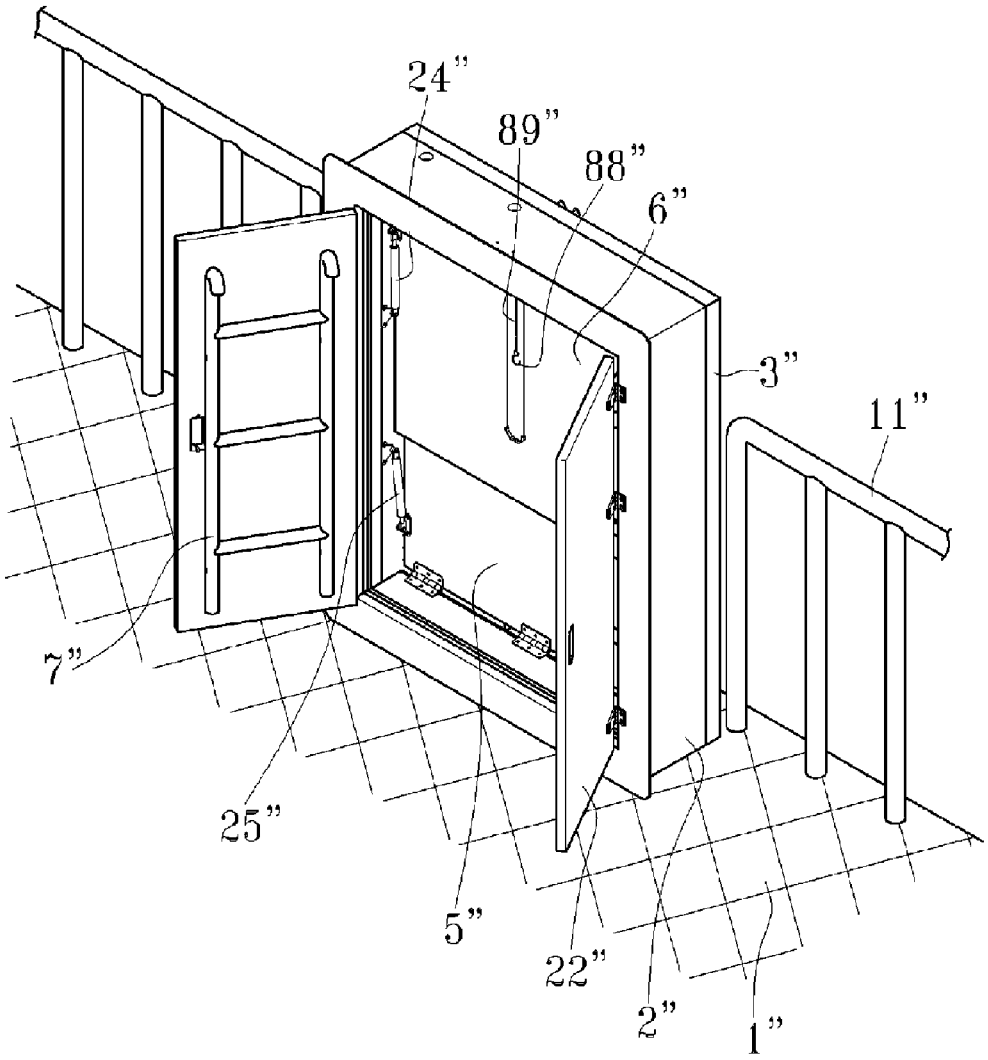
Figure 26B:
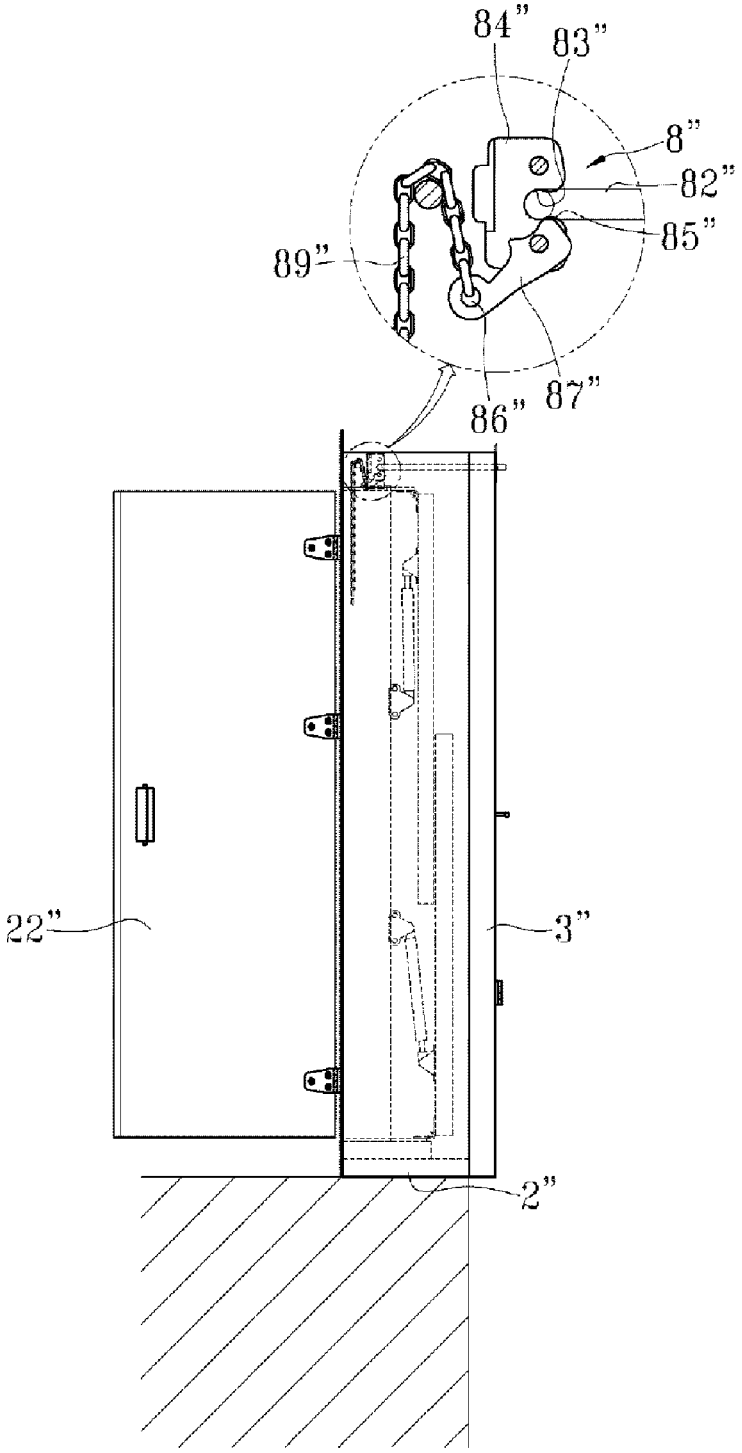
Figure 26C:
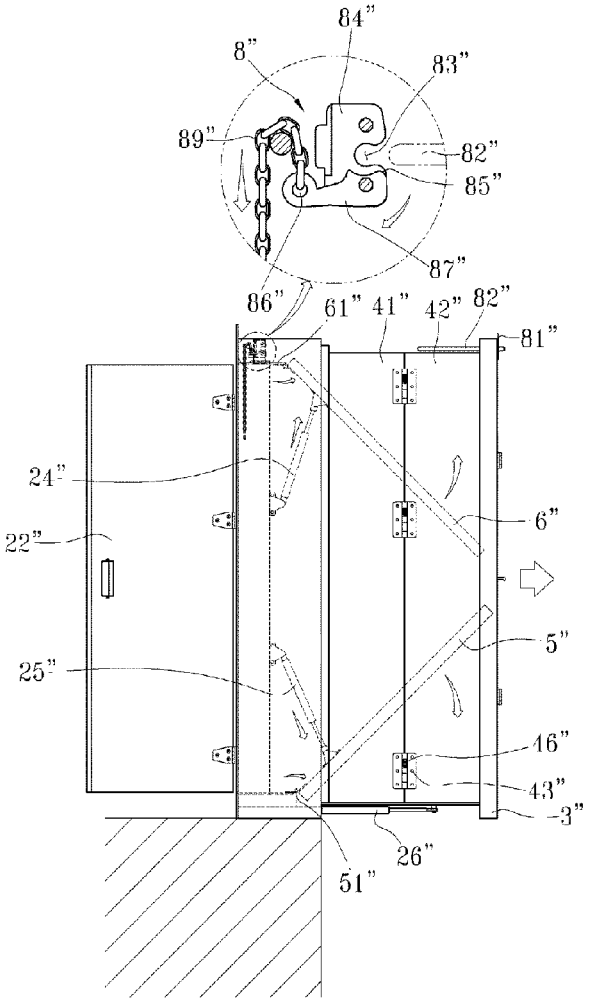
Figure 26D:
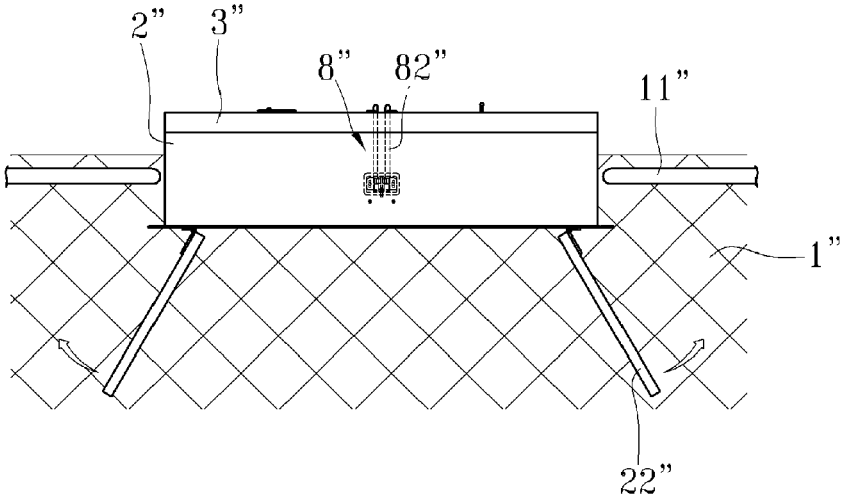
Figure 26E:
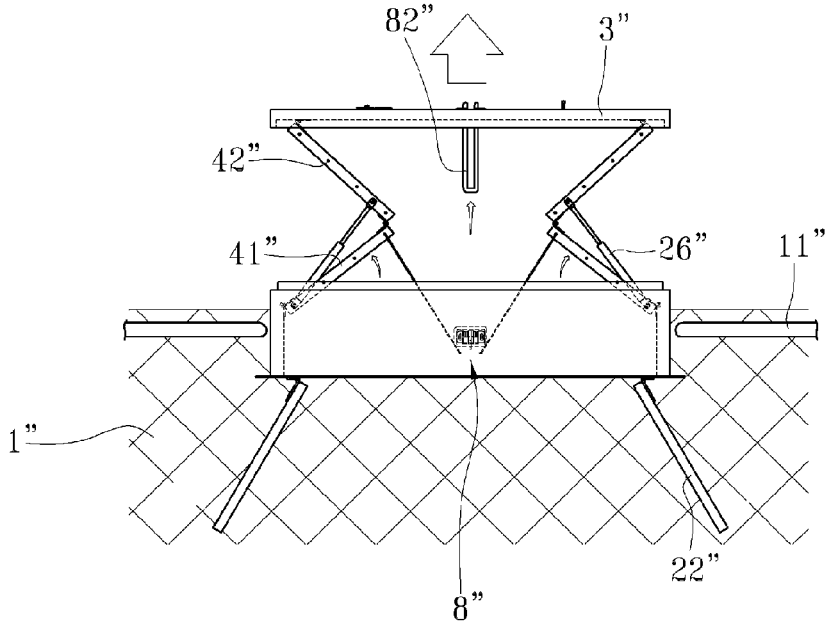
Figure 26F:
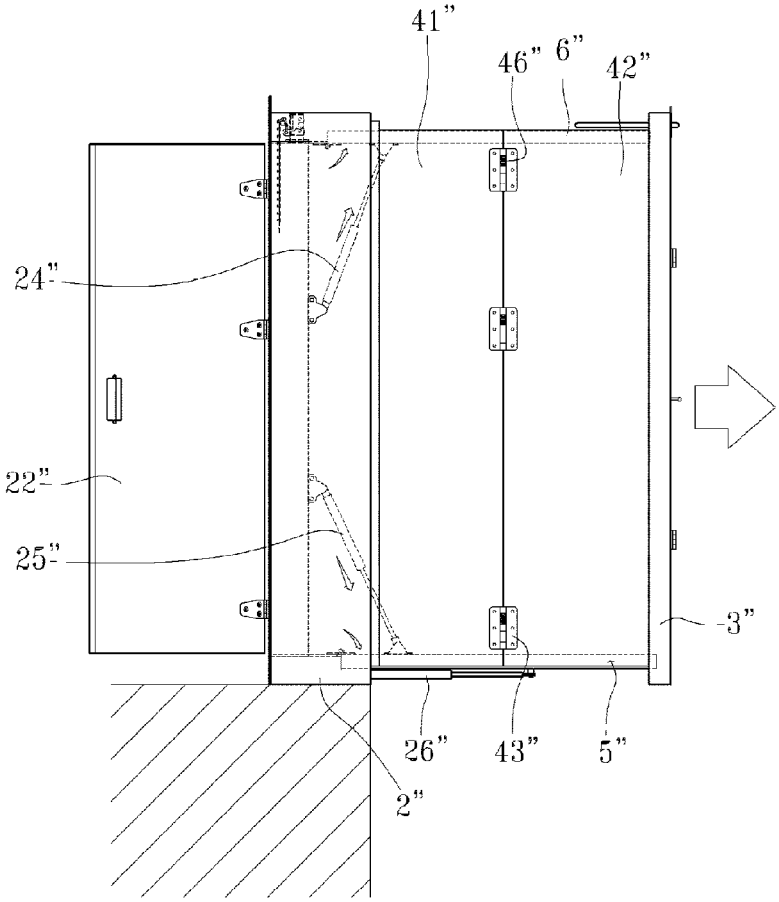
Figure 26G:
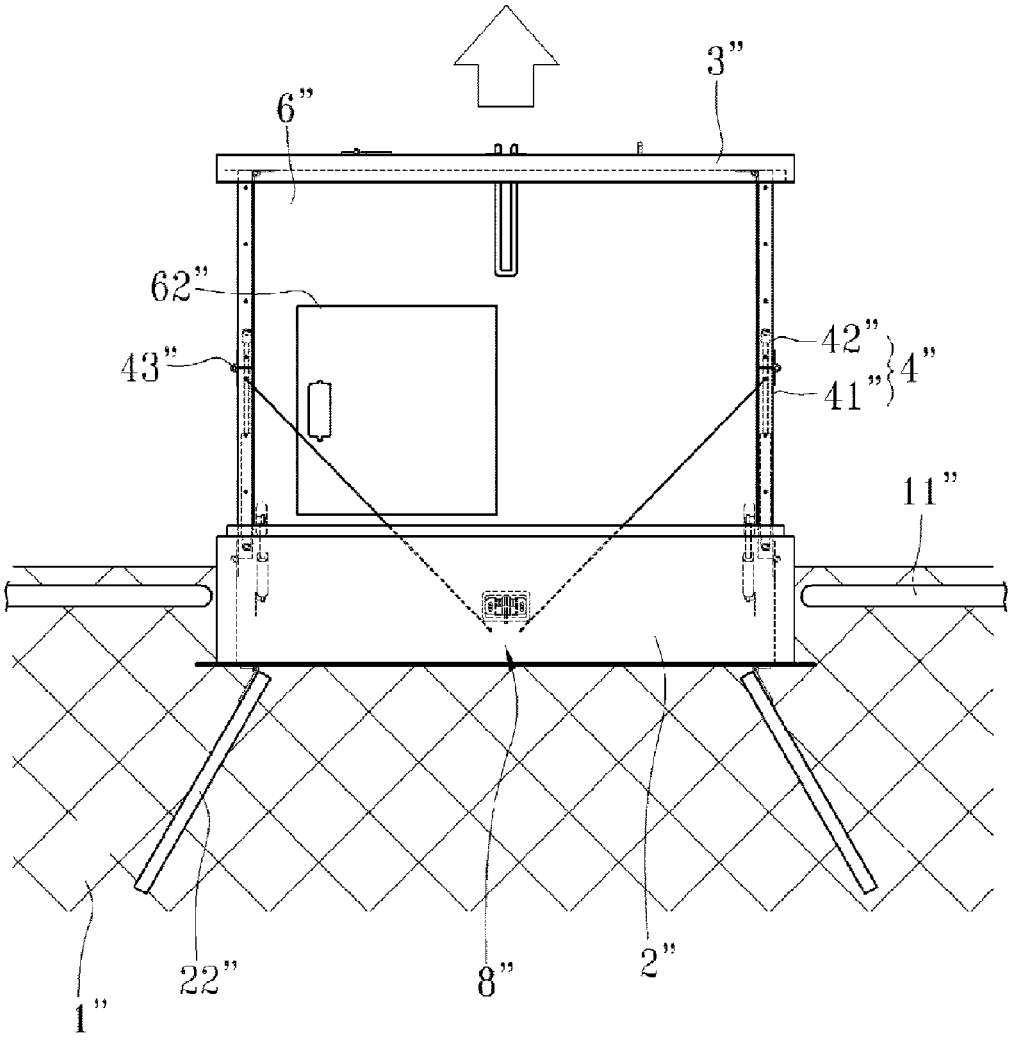

As illustrated in the drawings, the emergency evacuation installation according to a first embodiment may be in a rectangular form and fixed to a veranda 1 of a building at a railing 11. The present installation includes a rectangular frame 2 having an entrance 21 (doors 22' FIG. 18 and 22" FIG. 26*a*) at the front side, a rear panel 3 disposed rearward of the frame 2 and having an exit door 31, two side panels 4, a bottom panel 5 and a top panel 6, which jointly constitute a box-type of emergency escape shelter and is collapsible as bellows.

The present installation also includes a front cover 7 and a rear cover 8. The front cover 7 conforms to and tightly surrounds the rectangular frame 2 and extends rearward until it terminates at a first press-fit flange 71 which is bent inwardly at right angle. The rear cover 8 includes a main body fixed to the rear surface of the rear panel 3 with an opening formed not to interfere with the opening and closing of the exit door 31 and outer edges extending forward from the main body at right angle until it terminates at a second press-fit flange 82 from another inward right-angle bending so that the second flange 82 abuts the first flange 71 while the evacuation installation is fully collapsed.

The present disclosure recognizes that using various fabric or plastic sheets as an easy covering over such emergency installation may become an added risk factor to the actual emergency and time-sensitive situations for the building occupants who are trapped in an abrupt fire, if they are required to find the covered installation and get into the uncovering process with those sheets before using the same. Therefore, the emergency installation in this embodiment is configured to bring no possible interference with its intended operation and to enclose any unsightly and/or sensitive components protectively and invisibly as best as possible. To this end, the first and second press-fit flanges 71 and 82 typically maintain a close contact with each other to prevent damage to the components by reducing water from seeping into the interior of the installation.

Figure 6:
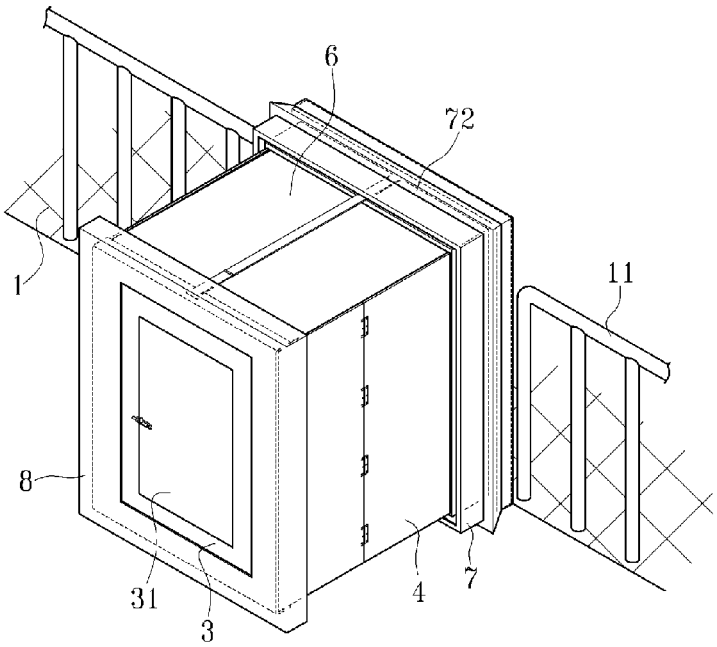
Figure 7:
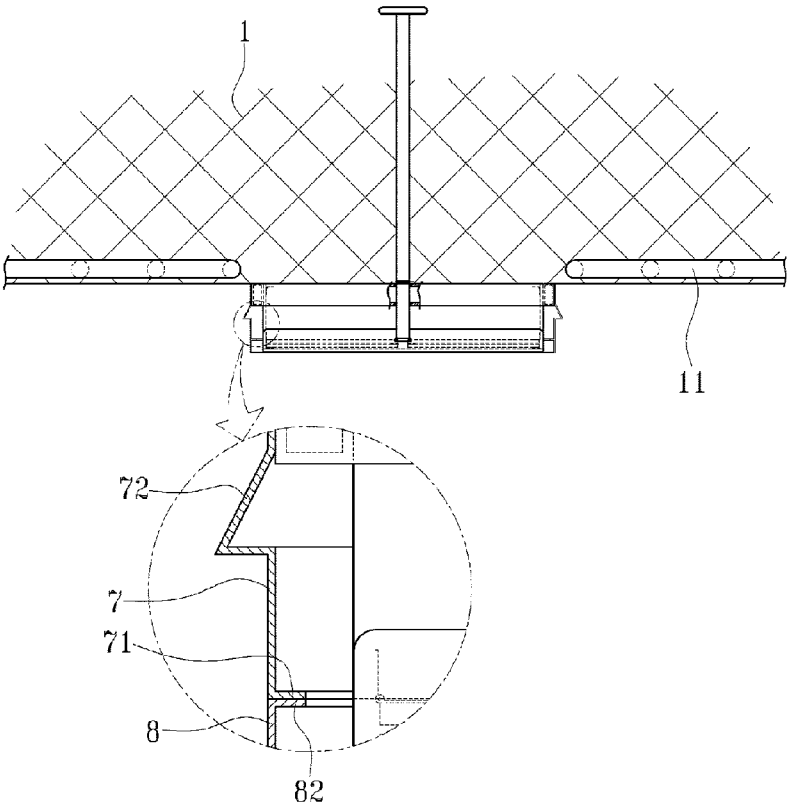
Figure 8:
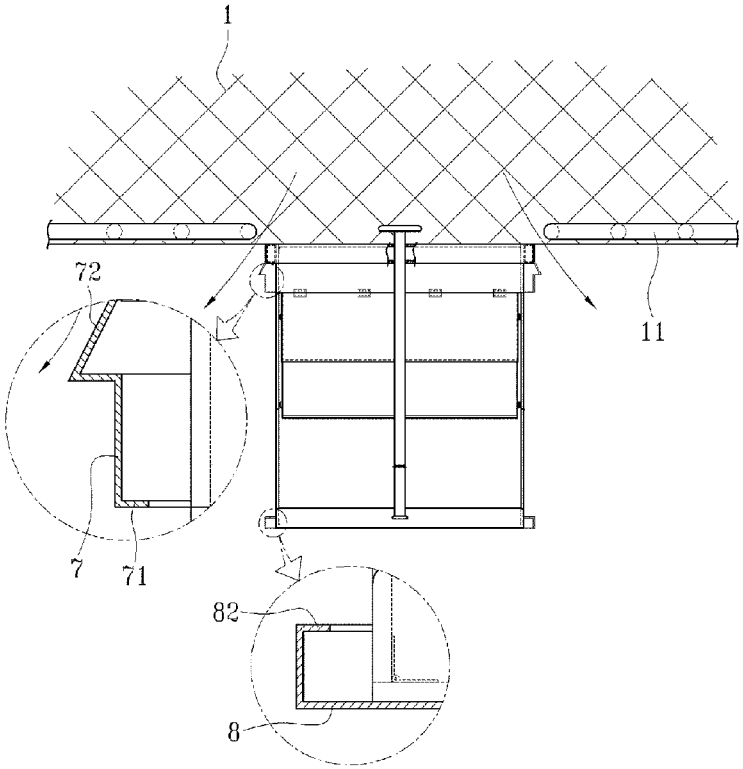

FIG. 6 is a perspective view in accordance with an extended example of the first embodiment of the present disclosure, FIG. 7 is a plan view according to the present embodiment, FIG. 8 is a conceptual diagram, wherein the front cover 7 further has a flame deflector 72 formed by gradually enlarging four side walls of the front cover 7 in a slant rearward and then reducing into a stepped end. This deflects and relieves uncontrollable flames from directly or indirectly heating up the inside of the installation even though it is adapted to comprise an insulating member for preventing heat transmission. Here, the flame deflector 72 is configured to guide the flame along inclined surface thereof for reducing the effect of heat or flame on the top panel 6, bottom panel 5 and especially side panels 4.

Figure 9:
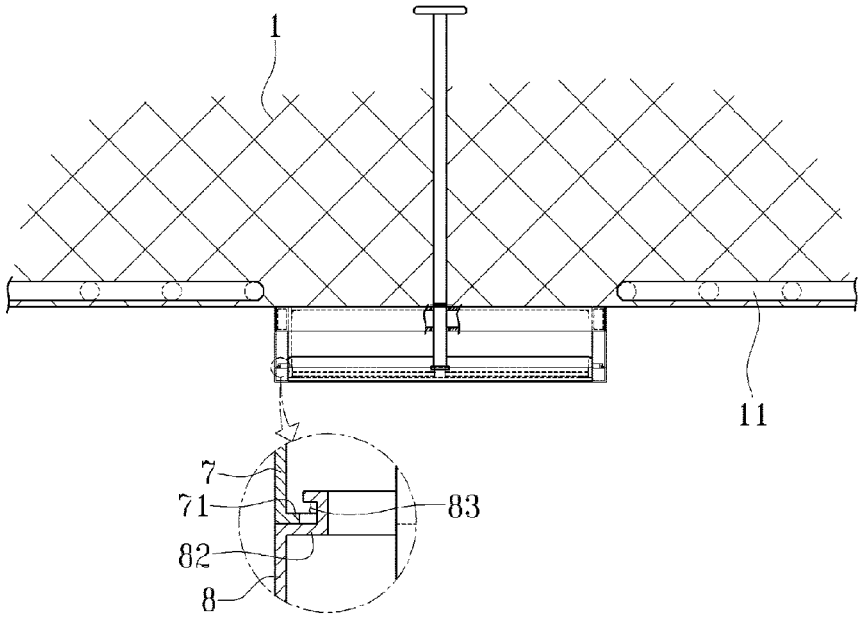
FIGS. 9 to 11*b* are diagrams of an emergency evacuation installation according to a second embodiment of the present disclosure.
Figure 10:
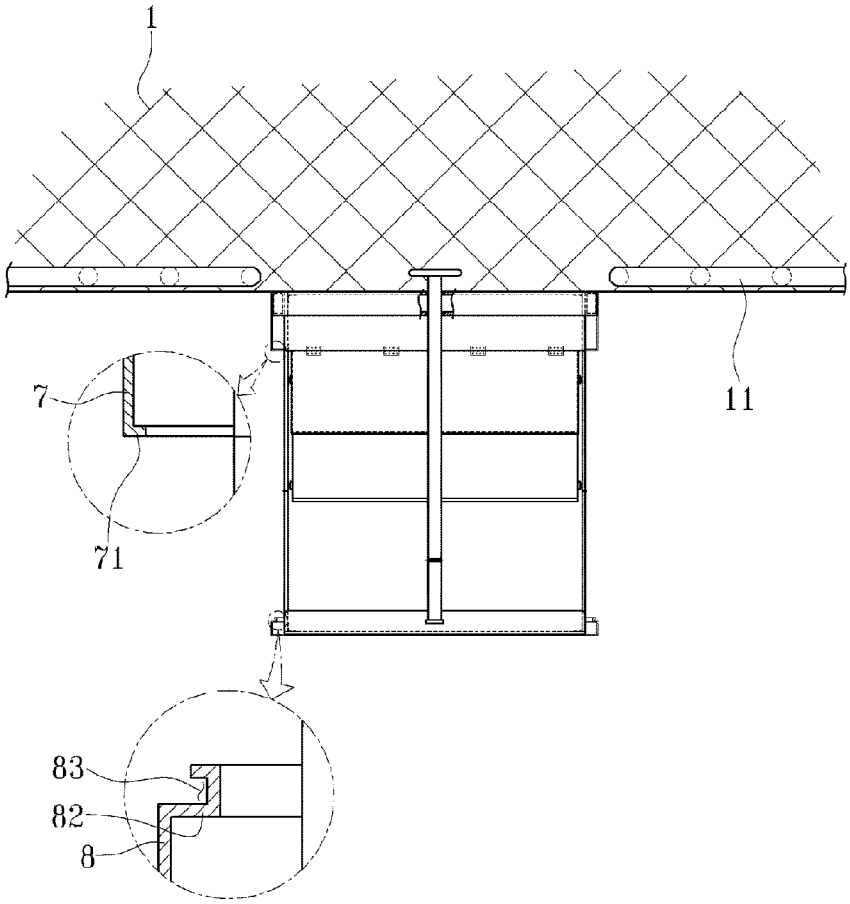
Figure 11A:
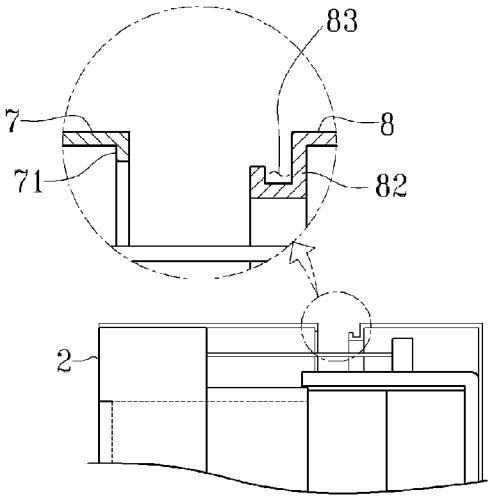
Figure 11B:
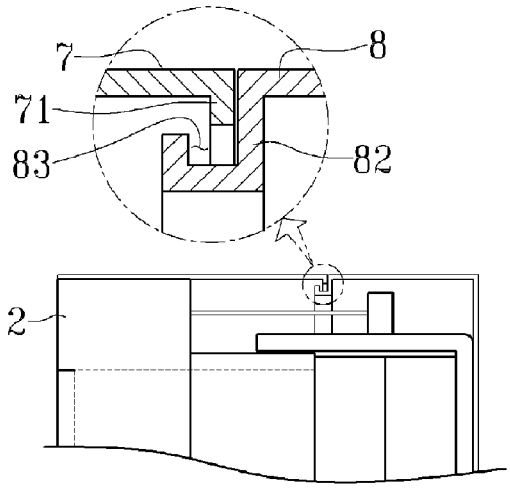

FIG. 9 is a plan view of a collapsed state of an emergency evacuation installation according to a second embodiment of the present disclosure, FIG. 10 is a plan view of an expanded state thereof, and FIGS. 11*a* and 11*b* are side cross-sectional views of the same, wherein one of the first and second press-fit flanges 71, 82 extends further inward and bends right toward the other along a slight extension and then bends again perpendicularly and outwardly to additionally form a draining section 83.

It is important to address corrosion which occurs rapidly around the components of the emergency evacuation installation including vulnerable hinges to the direct exposure to rainwater or humid winds causing reduced durability thereof. In view of this, the enclosure of the present embodiment is advantageously provided with a protective means as the draining section 83 arranged for collecting and expelling any intruded water.

Figure 12:
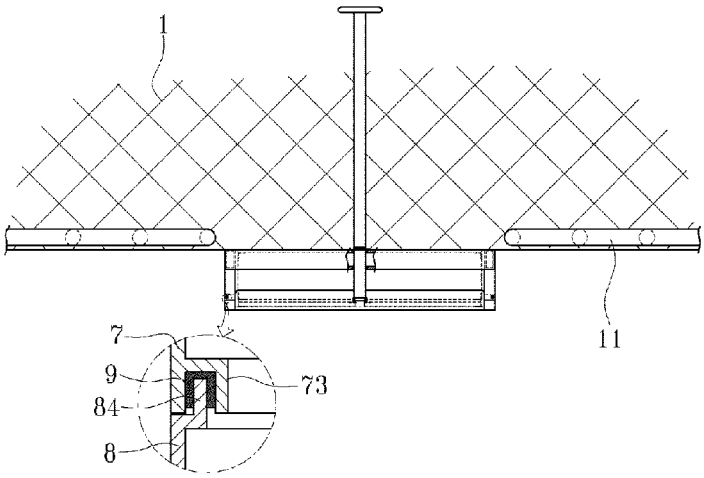
FIGS. 12 to 14*b* are diagrams of an emergency evacuation installation according to a third embodiment of the present disclosure.
Figure 13:
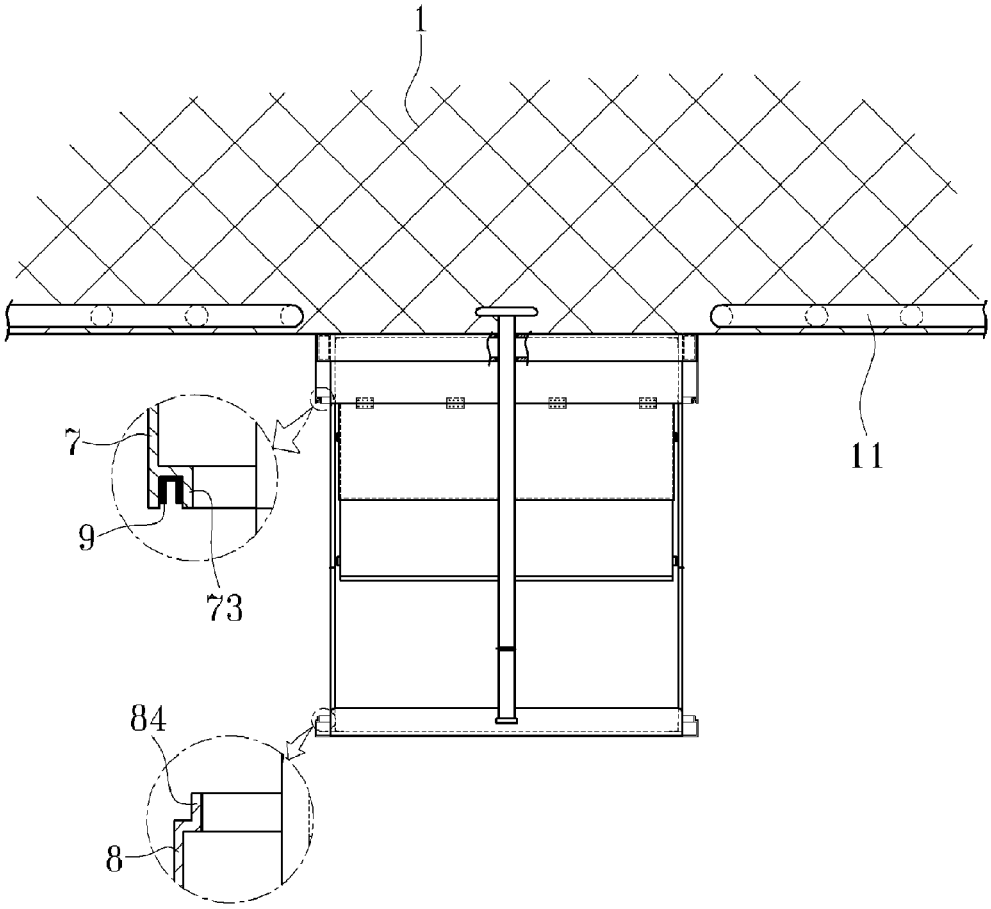
Figure 14A:
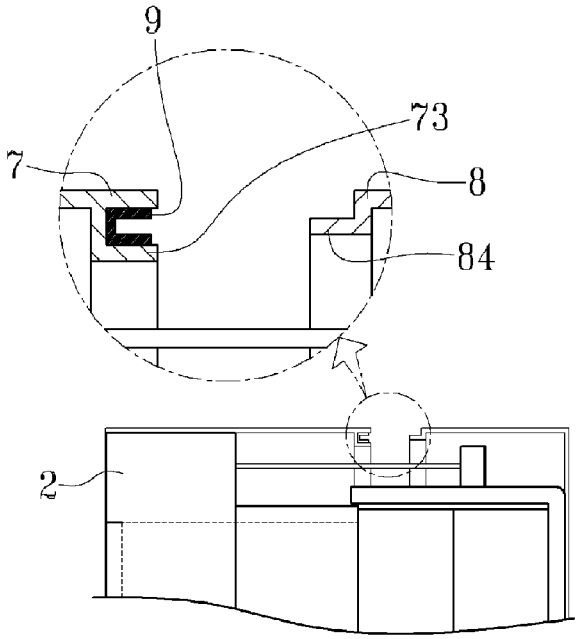
Figure 14B:
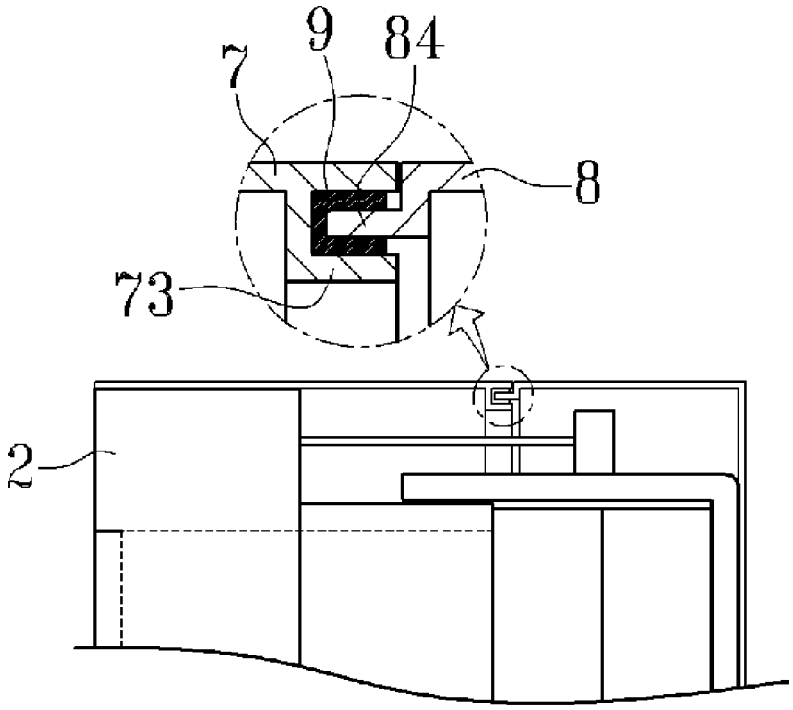

FIG. 12 is a plan view of a collapsed state of an emergency evacuation installation according to a third embodiment of the present disclosure, FIG. 13 is a plan view of an expanded state thereof, and FIGS. 14*a* and 14*b* are side cross-sectional views of the same, wherein the emergency evacuation installation has sealing mounting ribs 73, coupling ribs 84 and a sealing member 9. In this example, the sealing mounting ribs 73 are adjacent to the rear ends of the front cover 7 and extend by branching inwardly followed by rearward extensions to jointly form grooves along the rear boundary line of the front cover 7. The coupling ribs 84 extend at right angle from the front ends of the rear cover 8 and bend again to the front so that they are distally inserted in the grooves of the sealing mounting ribs 73. At this time, the sealing member 9 may have the shape of a rectangular ring with a corresponding groove along the rear ends of the front cover 7.

As described above, the seal member may be more positive method for resolving the problems of water and air leakages.

Figure 15:
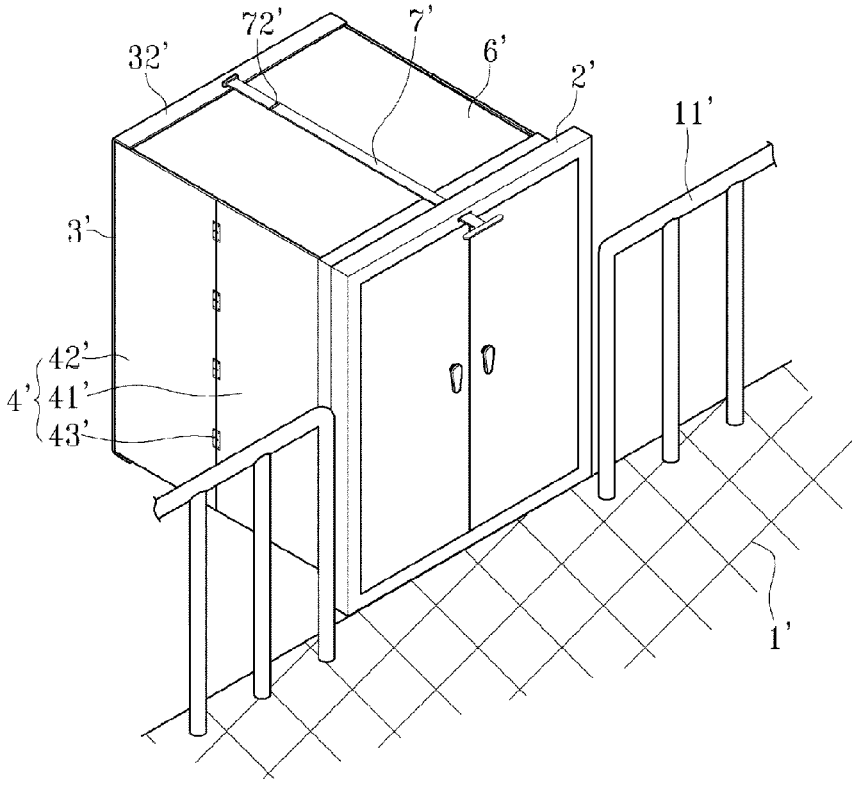
FIGS. 15 to 19*g* are diagrams of an emergency evacuation installation according to a fourth embodiment of the present disclosure.
Figure 16:
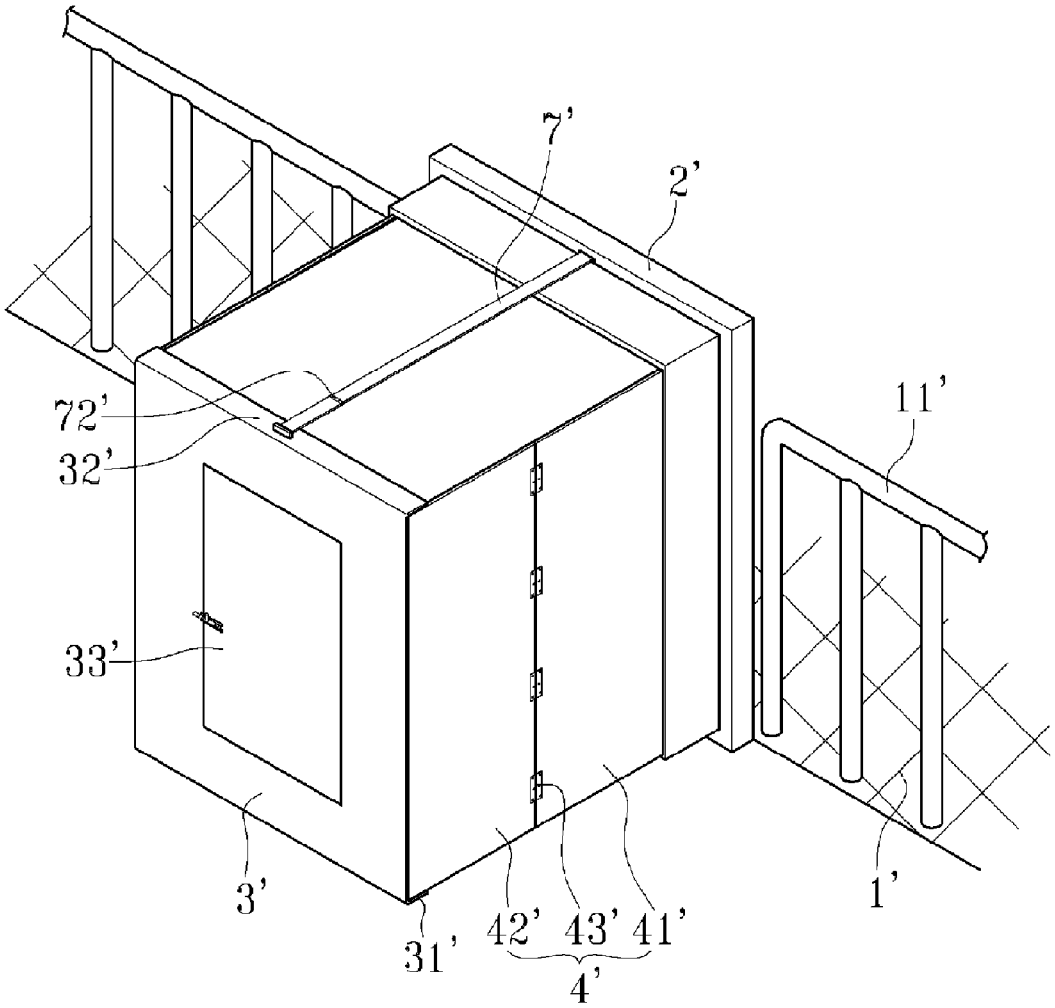
Figure 17:
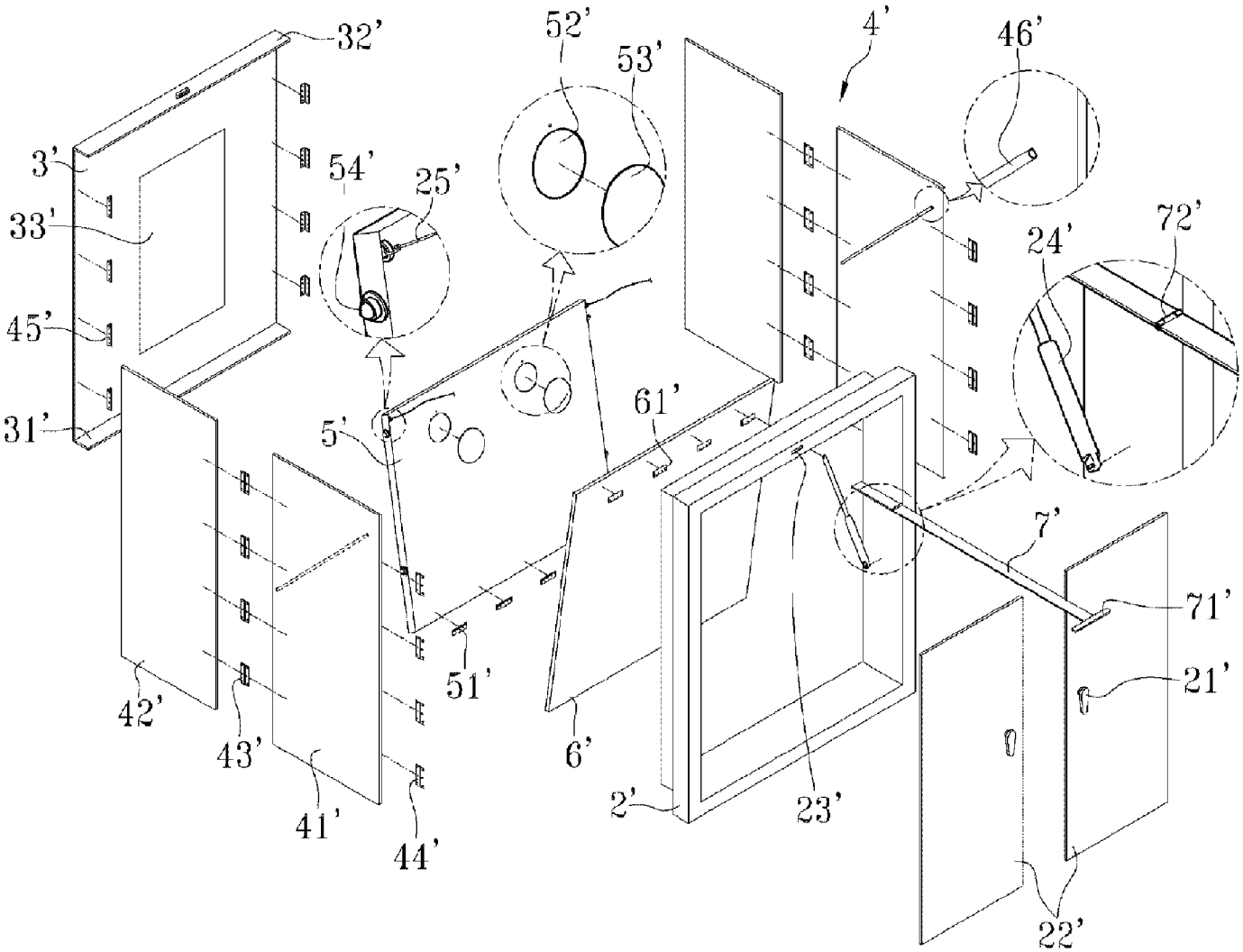
Figure 18:
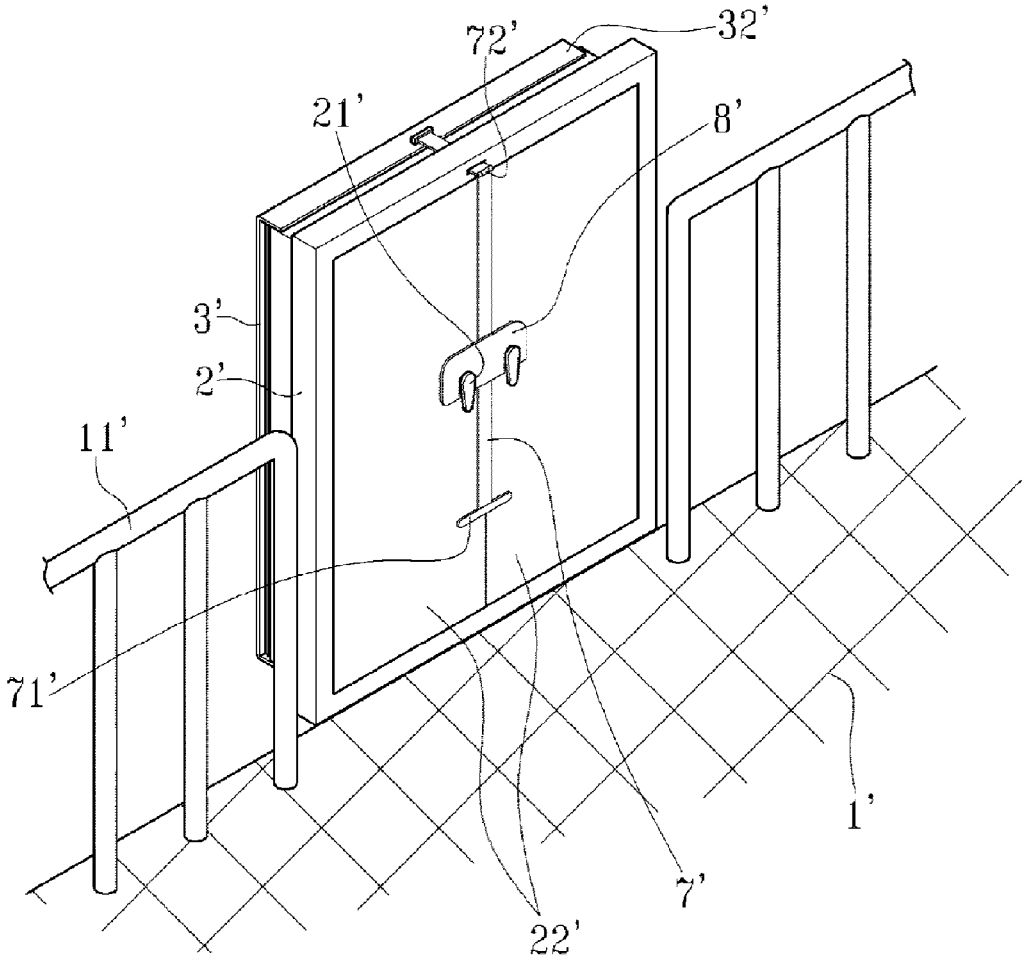
Figure 19A:
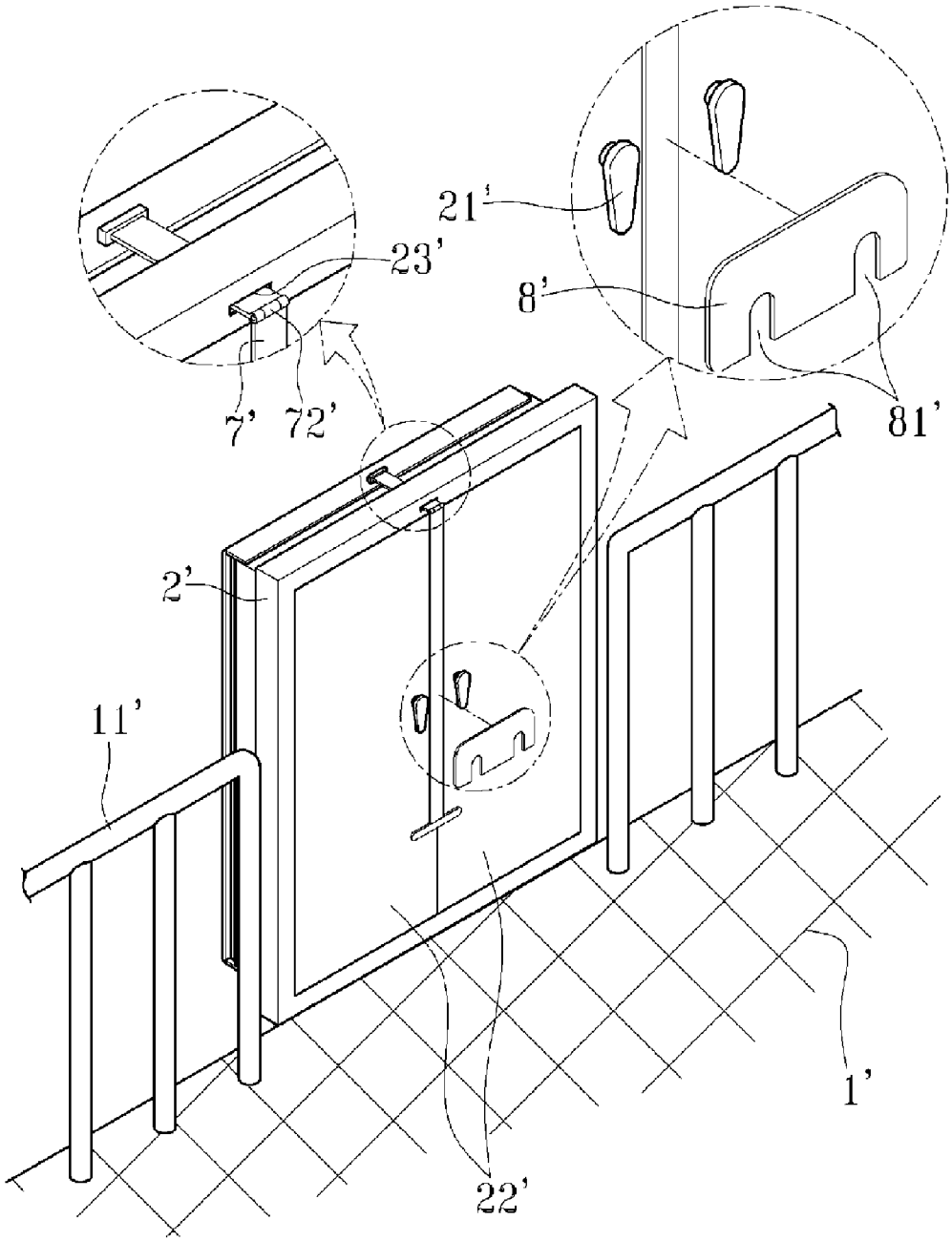
Figure 19B:
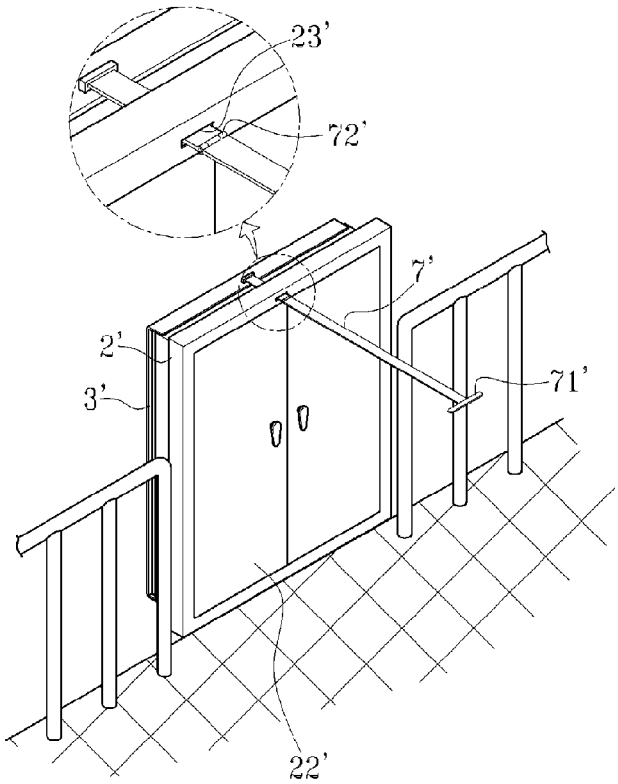
Figure 19C:
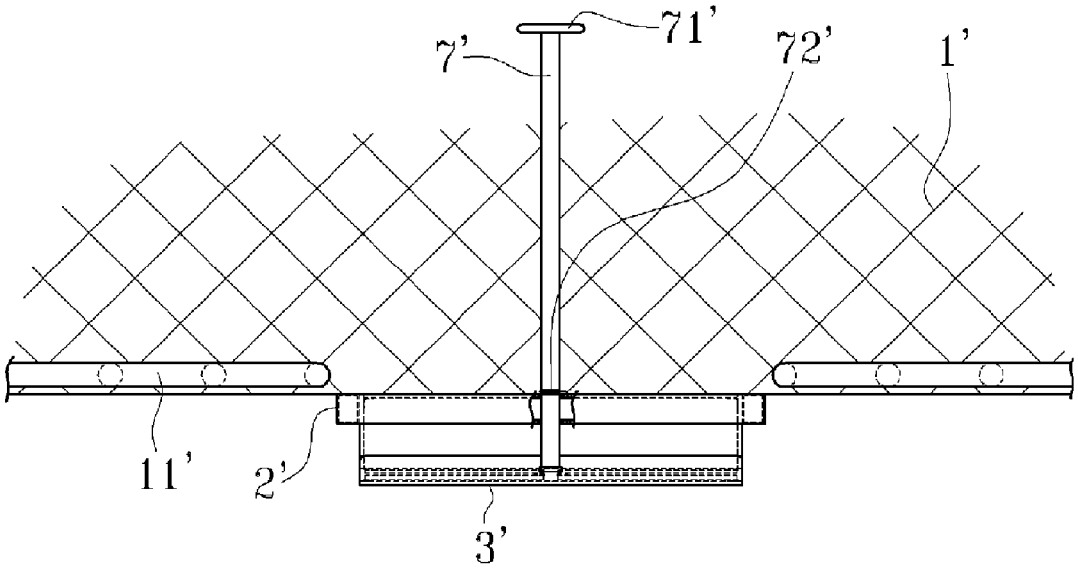
Figure 19D:
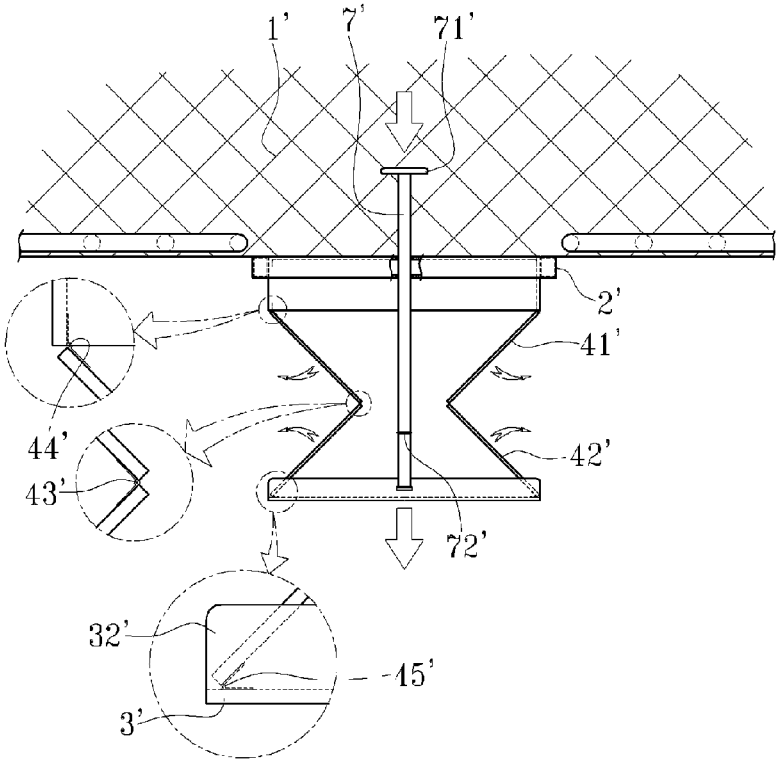
Figure 19E:
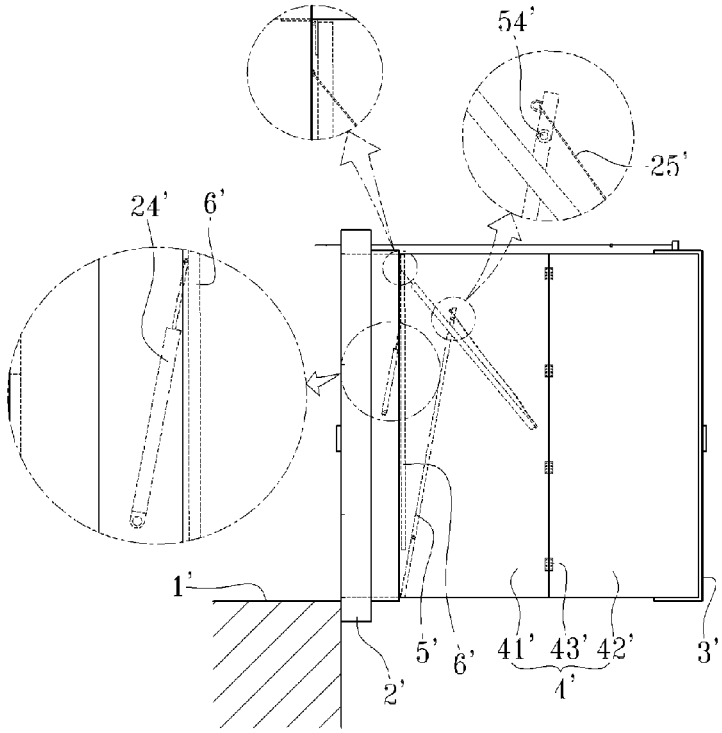
Figure 19F:
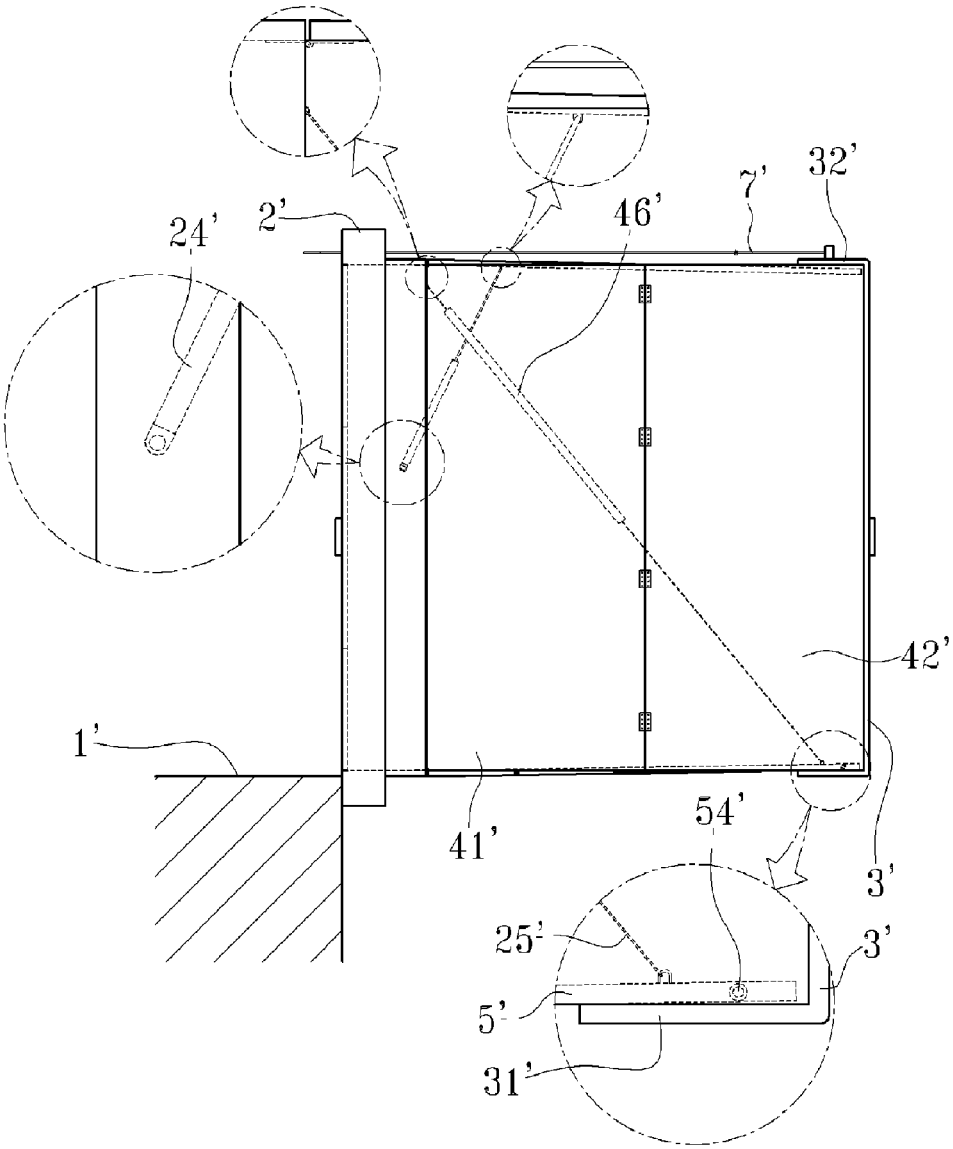
Figure 19G:
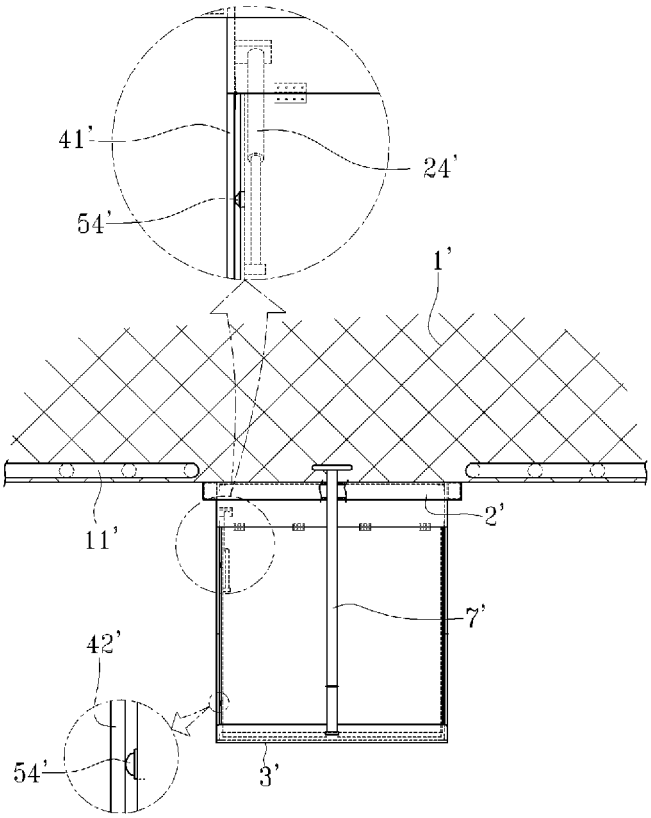

FIG. 15 is a perspective view of an expanded state of an emergency evacuation installation according to a fourth embodiment of the present disclosure, FIG. 16 is a rear perspective view of an expanded state of the same installation of FIG. 15, FIG. 17 is an exploded perspective view, and FIG. 18 is a perspective view of a collapsed state thereof, wherein the emergency evacuation installation is adapted to be mounted in the form factor of a box normally collapsed and readily deployed for accommodating a plurality of occupants safely in emergency situations such as fires.

The present emergency evacuation installation includes a rectangular frame 2', a rear panel 3', a couple of side panels 4', a bottom panel 5', a top panel 6' and an activation bar 7'. The frame 2' is fixed to the railing 11' of the veranda 1' having double doors 22' respectively hinged on both sides of the frame and each having a knob 21' projecting forward. The rear panel 3' is of a generally rectangular shape and is disposed rearward of the frame 2' and is provided with a bottom flange 31' and a top flange 32' formed respectively by forward right-angled bending of the rear panel 3' at its bottom and top ends with an exit door 33' formed centrally of the rear panel 3' so that it is externally accessed for opening. Each of the side panels 4' includes first and second panel 41' and 42' which are bisected vertically and interconnected in a foldable arrangement by a number of first hinges 43' and each side panel 4' is also connected at its front and rear ends by a number of second and third hinges 44', 45' foldably with the rear portion of the inside of the frame 2' and one lateral end of the rear panel 3', respectively. The bottom panel 5' has a lateral end attached to a number of fourth hinges 51' formed inside of a lower end portion of the frame 2' and at least one air inlet hole 52' with a closing and opening plate 53' adjustably disposed thereover so that the bottom panel 5' is dropped until it is stopped by the bottom flange 31' of the rear panel 3' to complete the floor surface as the emergency evacuation installation is deployed. The top panel 6' has a lateral end attached to a number of fifth hinges 61' formed inside of an upper end portion of the frame 2' and engages, when deployed, the bottom surface of the top flange 32' of rear panel 3'. The activation bar 7' is elongated and has one end fixed to the upper surface of the top flange 32' of the rear panel 3' and the opposite end passing through a guide hole 23' formed in the frame 2' and terminating by a handle portion 71'. The activation bar 7' is divided into two sections articulated by a hinge 72' so placed that it passes the guide hole 23' with all the panels collapsed and then bends vertically downwards to rest.

The above-described configuration allows the emergency evacuation installation to be fixedly mounted to the railing 11' of the veranda 1' for the occupants to make a quick temporary escape from the flames and toxic gases of fire. To this end, the emergency evacuation installation basically employs non-combustible materials while maintaining the interior space sealed from outside and allowing fresh air to flow in from the atmosphere selectively through the air inlet hole 52' to prevent the toxic gases from intruding.

More detailed description of the operation will be provided referring to the illustrative drawings.

FIGS. 19*a*to 19*g* are conceptual views of the steps of using the emergency evacuation installation according to the fourth embodiment. The activation bar 7' normally lies flat between the double doors 22' and it may be held under an optional key plate 8' having grooves 81' for inserting both knobs 21' to fasten the activation bar 7' and the double entrance doors 22' altogether. In case of failed evacuation from fire, the user can remove the key plate 8' first, lift the activation bar 7' about the hinge 72' to be horizontal, and then push it by the handle 71'.

Thus, the rear panel 3' is pushed rearward to unfold the side panels 4', i.e., the first and second side panels 41', 42' by means of the first hinges 43' out of their collapsed mode. Such deployments of the side panels 4' are accompanied by horizontal unfolding of the bottom panel 5' by its own weight.

At this time, in some embodiments of the present disclosure, the frame 2' is additionally provided with a hydraulic cylinder 24' having one end fixed to an interior portion of the frame 2' and the opposite end fixed to the top panel 6' to easily deploy the top panel 6' even without a manual endeavor.

Further, in other embodiments, two or more ball casters 54' are additionally installed on the bottom panel 5' where it makes close lateral contacts with the side panels 4' to minimize frictions therebetween.

This is intended to prevent the critical interference of the close side panels 4' with the deployment of the bottom panel 5'. In this way, the bottom panel 5' and top panel 6' are adapted to be opened until they come into close contact with the bottom flange 31' and top flange 32' and transform into a full box shaped safety pod where the users enter by the doors 22' and are covered until rescued by people on the ground or rescue workers.

At this time, the air inlet holes 52' can be installed with an air filter for effectively blocking the toxic gases. In addition, the exit door 33' in the rear panel 3' is desirably arranged to have a lock accessible only from outside for preventing the occupants from opening it inadvertently and thereby precluding the danger of falling until rescue workers get to unlock the door 33'. In this case, the bottom panel 5' that takes the load of the occupants can additionally use a reinforcement which includes one or more wires 25' and corresponding wire guides 46' to advantageously distribute the load to bear. Each of the wires 25' has one end attached to an upper portion of the frame 2' and the other end attached to the bottom panel 5' at either lateral end near where it contacts with the lower flange 31' of the rear panel 3', and the length of the wire 25' is determined to permit the bottom panel 5' to unfold up to the horizontal limit. The wire guide 46' is formed as a long tube installed in the first side panel 4' that is coupled to the frame 2' for the wire 25' to run through the wire guide 46' which is installed in the corresponding orientation to the wire 25' when activated with the bottom panel 5' expanded.

Figure 20:
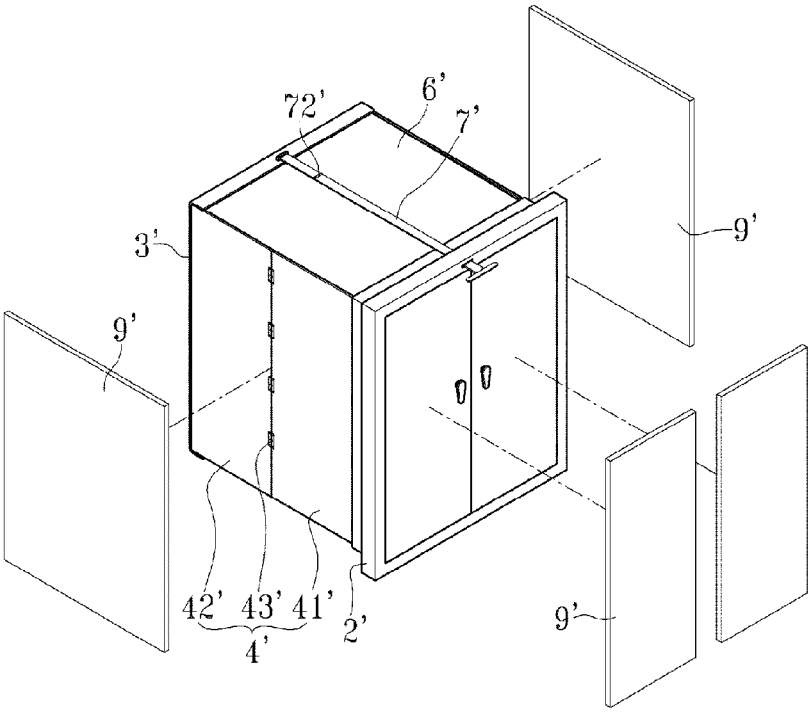
FIG. 20 is diagram of an emergency evacuation installation according to an alternative embodiment of the present disclosure.

FIG. 20 is an exploded perspective view of an emergency evacuation installation according to a modified embodiment of FIG. 19, whereby illustrating a heat insulating material 9' installed on the outer surfaces of the respective panels 2', 3', 4', 5', 6' for example.

The present embodiment employs the heat insulating material 9' to address the heat of the flame which will be delivered to the occupants through the evacuation installation if it is simply made with metal which then can work as a medium of heat to cause burns or extreme conditions for the occupants to bear.

Figure 21:
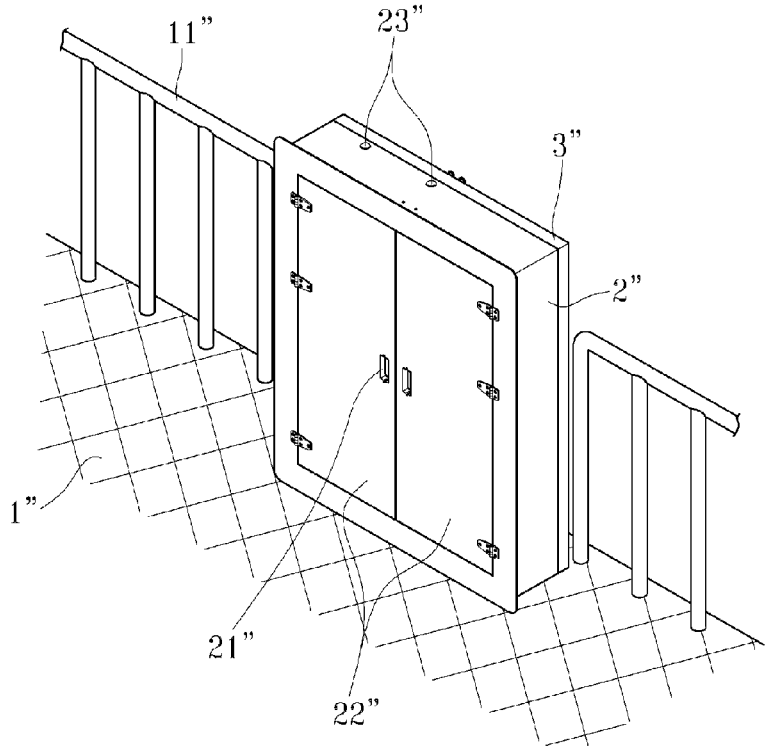
FIGS. 21 to 29*e* are diagrams of an emergency evacuation installation according to a fifth embodiment of the present disclosure.
Figure 22:
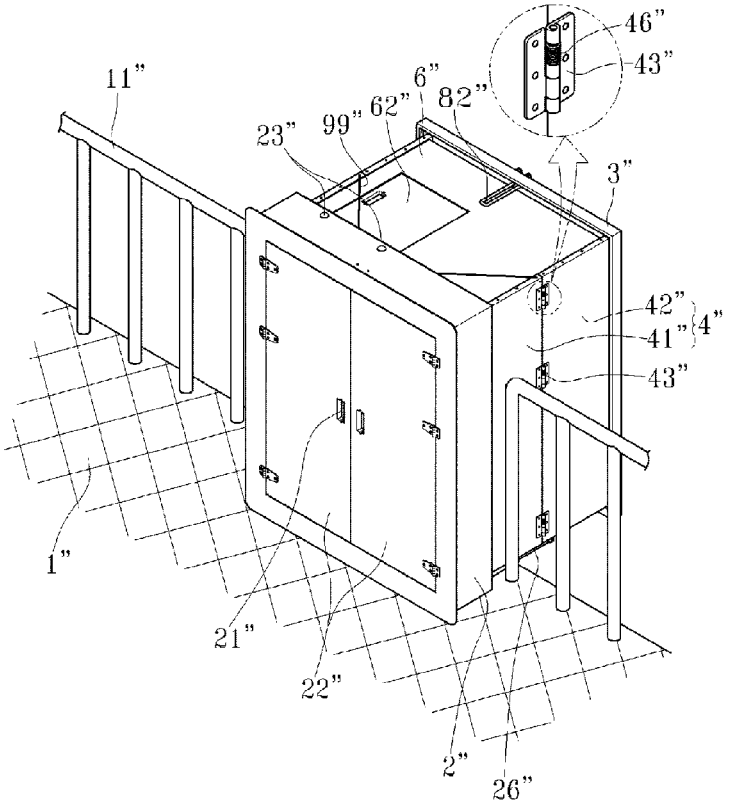
Figure 23:
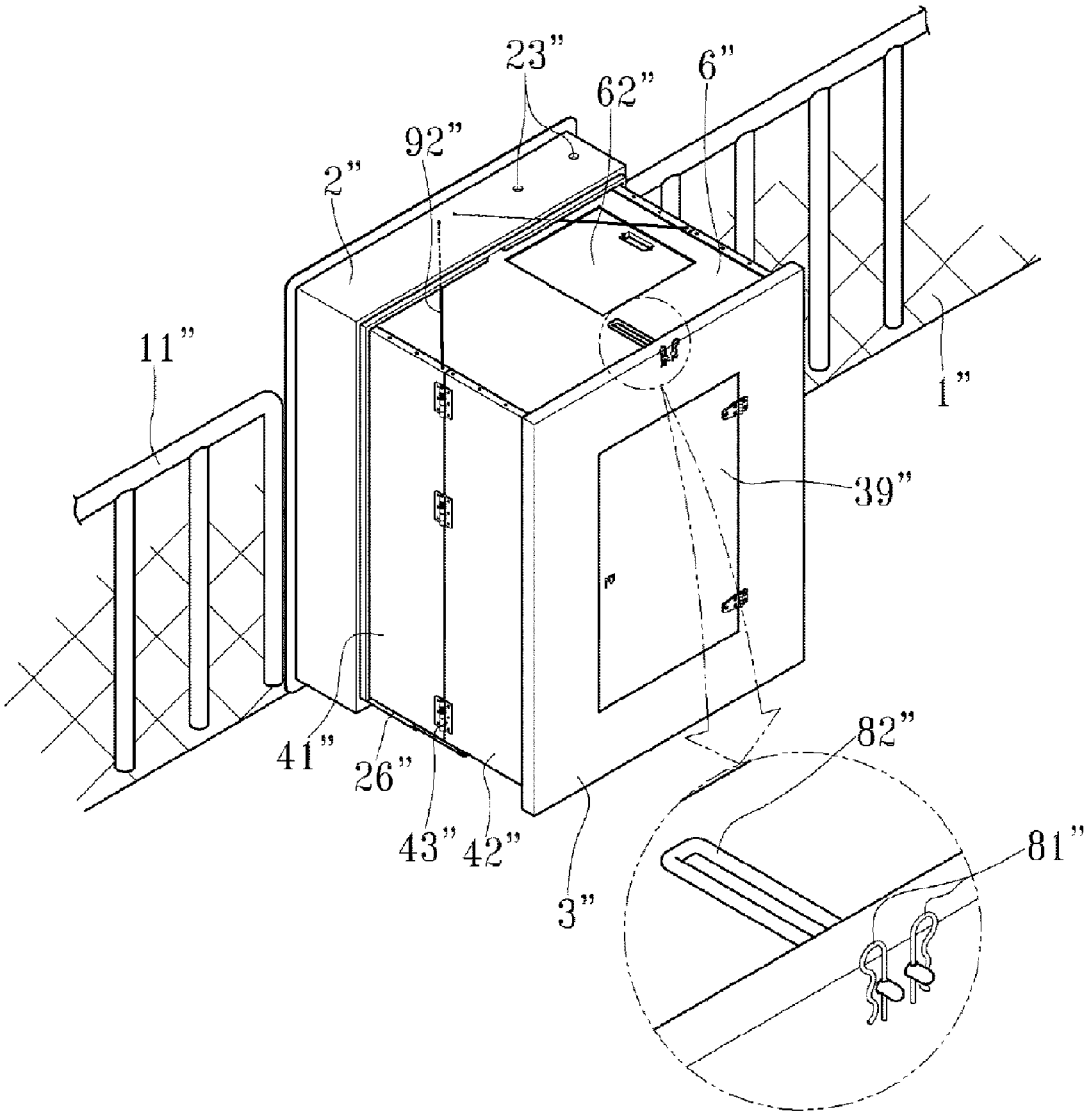
Figure 24:
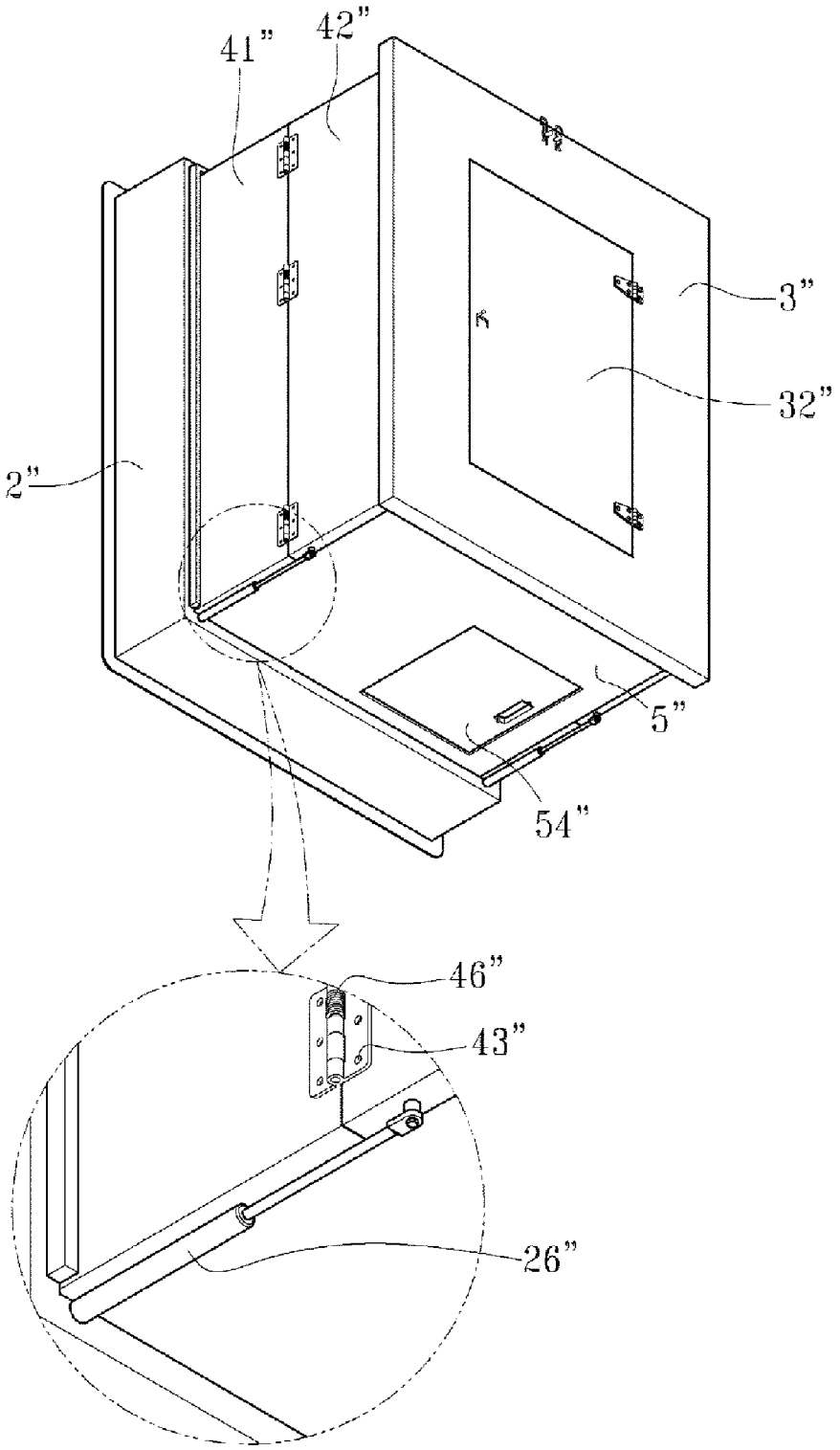
Figure 25:
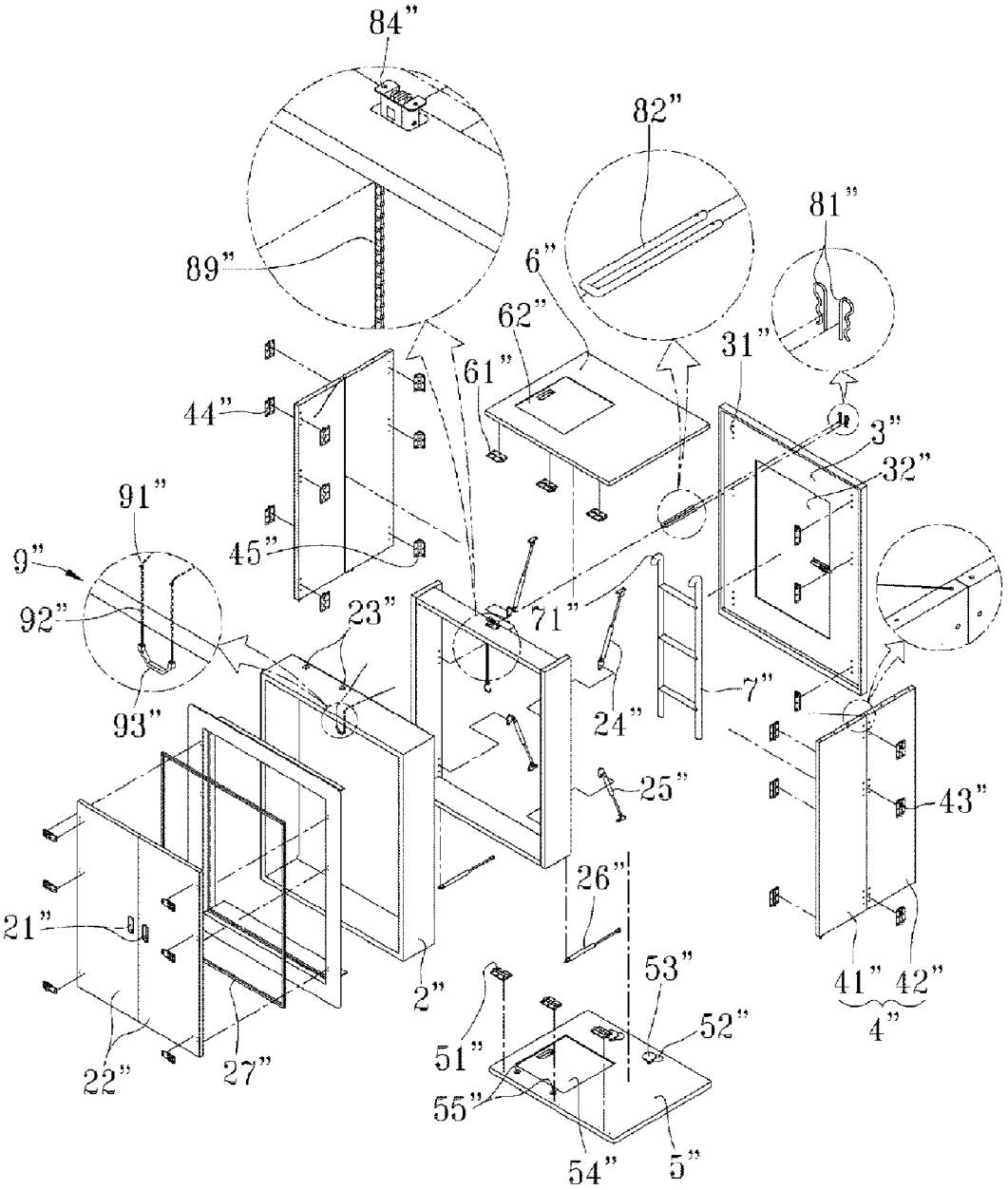

FIG. 21 is a perspective view of an emergency evacuation installation when collapsed, according to a fifth embodiment of the present disclosure, FIG. 22 is a perspective view of an expanded state, FIG. 23 shows the expanded state in rear perspective view, FIG. 24 is a bottom perspective view of the expanded state, and FIG. 25 is an exploded perspective view thereof.

As illustrated, the emergency evacuation installation is adapted to be attached to one side of a railing 11" of a veranda 1" in a building in the form factor of a box normally collapsed and readily deployed for accommodating a plurality of occupants safely in emergency situations such as fires.

The present emergency evacuation installation includes a frame 2", a rear panel 3", a couple of side panels 4", a bottom panel 5", a top panel 6" and an emergency ladder 7". The frame 2" is fixed to the railing 11" of the veranda 1" having double entrance doors 22" respectively hinged on both sides of the frame and each having a knob 21" projecting forward and a pair of first ladder docking holes 23" extending vertically through the frame 2" and opening towards the upper surface of the frame 2". The rear panel 3" has a rectangular shape and is disposed rearward of the frame 2" and is provided with a flange 31" formed by forward right-angled bending of the periphery of the rear panel 3" with an exit door 32" formed centrally of the rear panel 3". Each of the side panels 4" includes a first and a second panel 41" and 42" which are interconnected in an inwardly folding arrangement by a number of corresponding first hinges 43" and each side panel 4" is also connected at its front and rear ends by a number of second and third hinges 44", 45" foldably with the rear portion of the inside of the frame 2" and one lateral end of the rear panel 3", respectively. The bottom panel 5" has a lateral end attached to a number of fourth hinges 51" formed inside of a lower end portion of the frame 2", at least one air inlet hole 52" with a closing and opening plate 53" adjustably disposed thereover, a lower sliding door 54" configured to be pushed sideways to slide open a predetermined portion of the bottom panel 5", and a pair of second ladder fixture holes 55" extending through the bottom panel 5" and located between the lower sliding door 54" and the double entrance doors 22" so that the bottom panel 5" is expanded until it is stopped by a lower section of the flange 31" of the rear panel 3" to complete the floor surface as the emergency evacuation installation is deployed. The top panel 6' has a lateral end attached to a number of fifth hinges 61" formed inside of an upper end portion of the frame 2" and an upper sliding door 62" configured to be pushed sideways to slide open a predetermined portion of the top panel 6", and engages, when deployed, a downward surface of an upper section of the flange 31". The emergency ladder 7" is installed inside of one of the double entrance doors 22" and has upper hooks 71" each bent into a forward curve terminated by a distal end which can be inserted in each of the second ladder fixture holes 55" and foots which can be inserted in another pair of first ladder docking holes 23" of a downstairs emergency evacuation installation once the emergency evacuation installation is repeatedly attached in a column over the building.

The above-described configuration allows the emergency evacuation installation to be fixedly mounted to the railing 11" of the veranda 1" for the occupants to make a quick temporary escape from the flames and toxic gases of fire. To this end, the emergency evacuation installation employs non-combustible materials while maintaining the interior space sealed from the outside and allowing fresh air to flow in from the atmosphere selectively through the air inlet hole 52" to prevent the toxic gases from intruding. The emergency evacuation installation further includes the emergency ladder 7" to easily interlink with a similar emergency evacuation installation downstairs and thereby enabling floor-to-floor migrations of the evacuees and escape to safer one of those emergency evacuation installations once they are adopted up and downstairs in the building.

More detailed description of the operation will be provided referring to the illustrative drawings.

Figure 27:
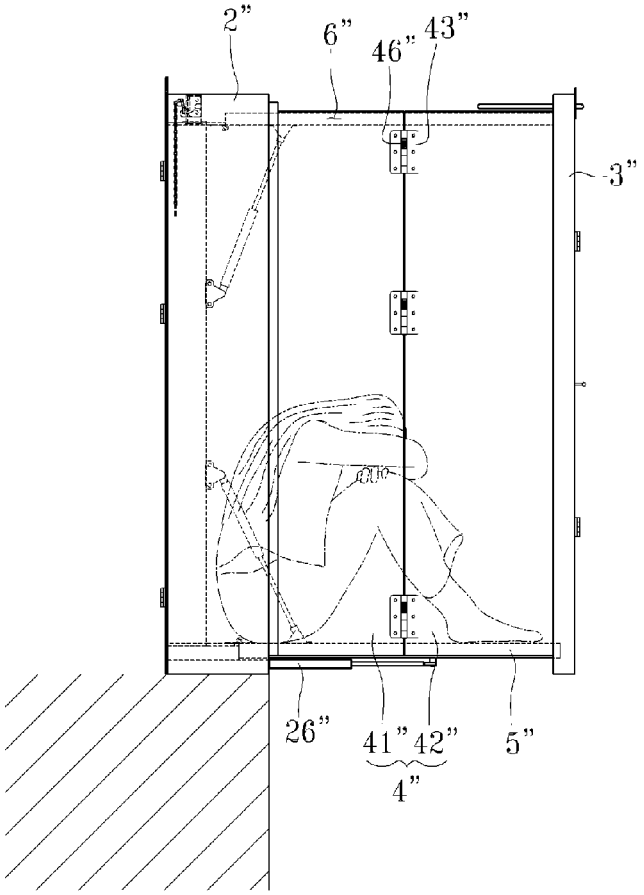

FIGS. 26*a* to 26*g* are conceptual diagrams illustrating a process of using the installation for the purposes of emergency evacuation in accordance with the exemplary embodiment of the present disclosure. FIG. 27 is a conceptual diagram of the disclosed installation activated by an occupant according to an embodiment of the present disclosure.

The aforementioned drawings additionally show a locking means 8" (FIGS. 23, 26*b*) including a locking member 82", a rotational link 87", a locking bracket 84" and a first wire 89". The locking member 82" is formed as a U-hook with two arms penetrating the rear panel 3" from its front upper portion towards the rear and secured in place with a pair of cotter pins or locking pins 81" pressed through holes formed distally of the two arms. The locking bracket 84" is attached to a top inner portion of the frame 2" and has a locking groove 83" for accepting an insertion of the front end of the locking member 82". The rotational link 87" is rotatably mounted on the locking bracket 84" and has one end provided with a hook 85" for responsively latching the locking member 82" as it enters the locking groove 83" and the opposite end provided with a wire connecting portion 86". The first wire 89" is connected at its one end to the wire connecting portion 86" of the rotational link 87" and is guided up and then draped down terminating with a release knob 88".

In the above example, with the entrance doors 22" open, one can recognize the visible release knob 88" of the locking means 8" to pull the rotational link 87" out of engagement with the locking member 82" for releasing it from the locking groove 83" of the locking bracket 84".

Thus, the back panel 3" may be pushed rearward, the side panels 4", i.e. first and second panels 41", 42" are unfolded about the first hinges 43", when the bottom panel 5" expands horizontally by its own weight about its articulated junction by the fourth hinge 51". To ensure easier performance of the deployment process, the present disclosure in some embodiments additionally installs a first pair of hydraulic cylinders 24", a second pair of hydraulic cylinders 25" and a third pair of hydraulic cylinders 26". The first pair of hydraulic cylinders 24" are fixed at the proximal ends, for example to the interior of the frame 2" with the distal ends being fixed to the top panel 6" to thrust the top panel 6" in the intended direction of deployment. The second pair of hydraulic cylinders 25" is fixed at the proximal ends to the interior of the frame 2" with the distal ends being fixed to the bottom panel 5" to thrust the bottom panel 5" in its intended direction of deployment. And the third pair of hydraulic cylinders 26" is fixed at the proximal ends to the lower rear portion of the frame 2" with the distal ends being fixed to the second side panels 42" to thrust the first and second side panels 41", 42" in their intended direction of deployment.

The present embodiment uses the first to third pairs of hydraulic cylinders 24", 25" and 26" to obviate the need for a manual endeavor of even the elderly or children, saving the precious energy and attention in the emergency situations.

Another method for automatically deploying the emergency evacuation installation is to install a torsion spring on each of the hinges. The present disclosure in some embodiments provides torsion springs 46" (FIG. 24) mounted on the rotation axes of the first hinges 43" for interconnecting the first and second side panels 41" and 42" to urge these panels towards their intended positions of deployment.

Upon expansions of the series of panels in case of fire, victims can enter the established emergency evacuation installation away from the flame and toxic gas until rescue workers and people on the ground come to rescue. At this time, the air inlet holes 52' (shown in FIG. 25) can be installed with an air filter for effectively blocking the toxic gases. In addition, the contact surface between the entrance doors 22" and the frame 2" may be fitted with a gasket 27" for preventing harmful gas and smoke from entering the interior of the installation through a clearance about the doors 22". In addition, the exit door 32" in the rear panel 3" is desirably arranged to have a lock accessible only from outside for preventing the occupants from opening it inadvertently and thereby precluding the danger of falling until rescue workers get to unlock the exit door 32".

Figure 28A:
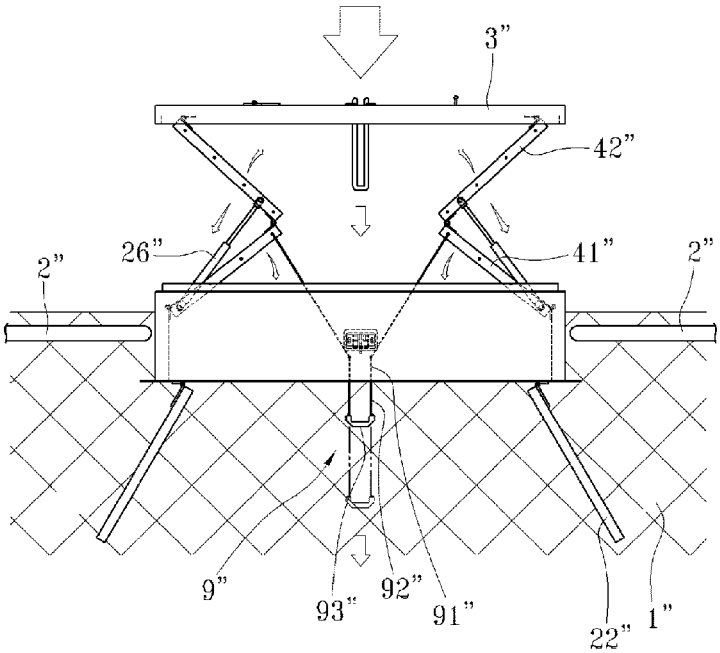
Figure 28B:
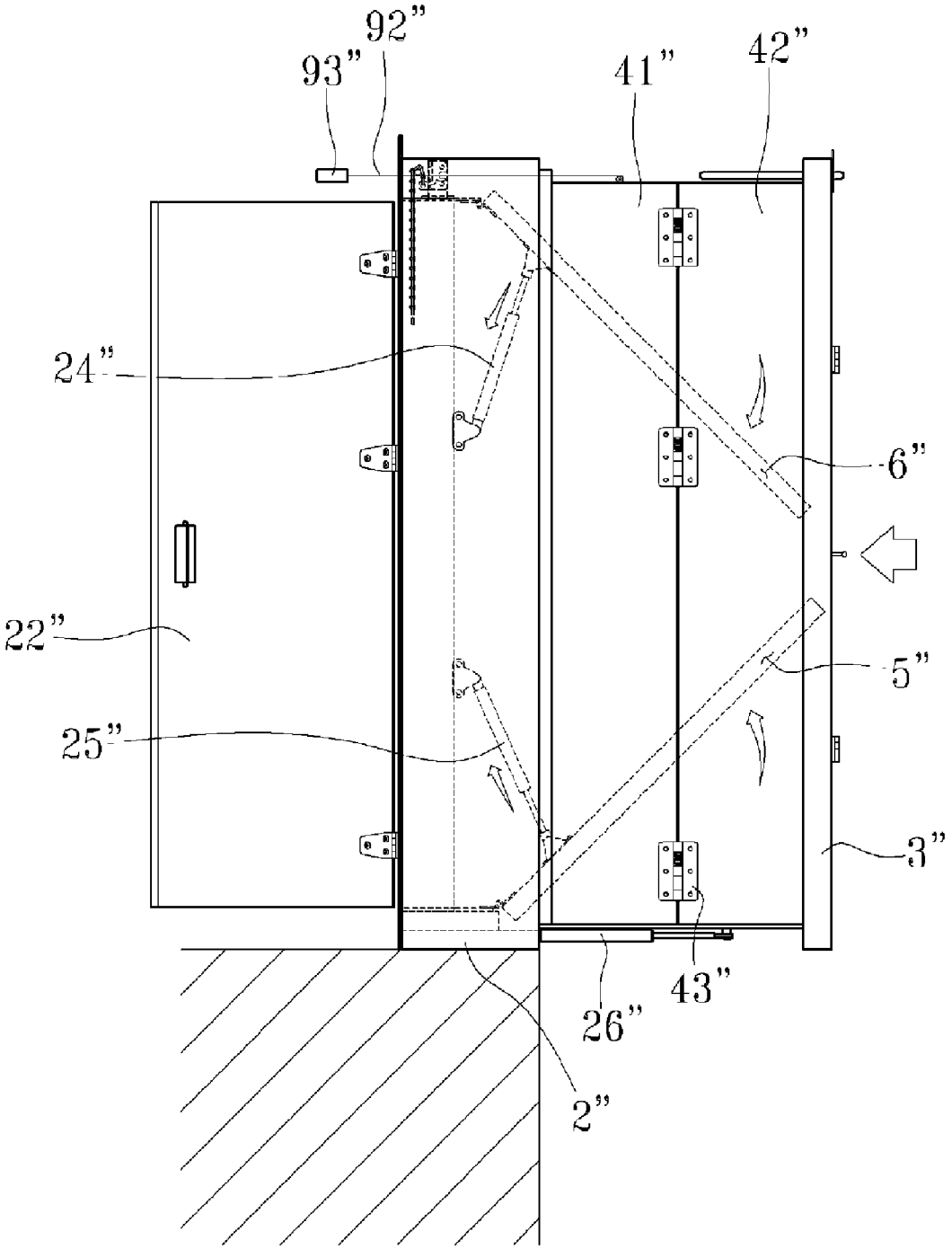
Figure 29A:
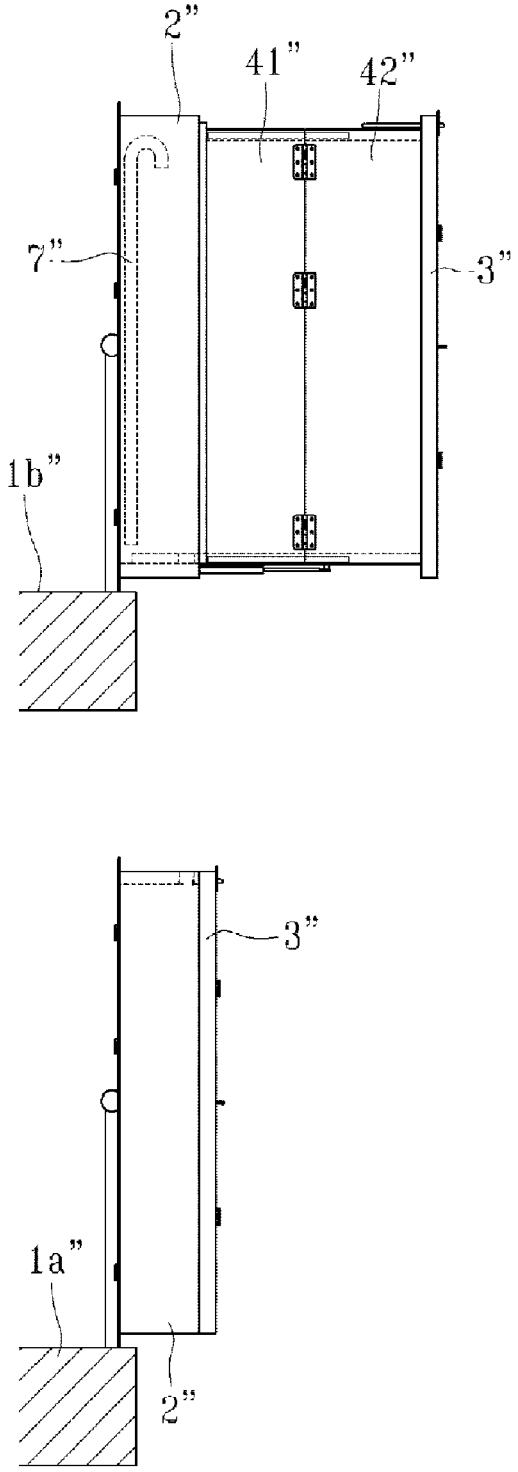
Figure 29B:
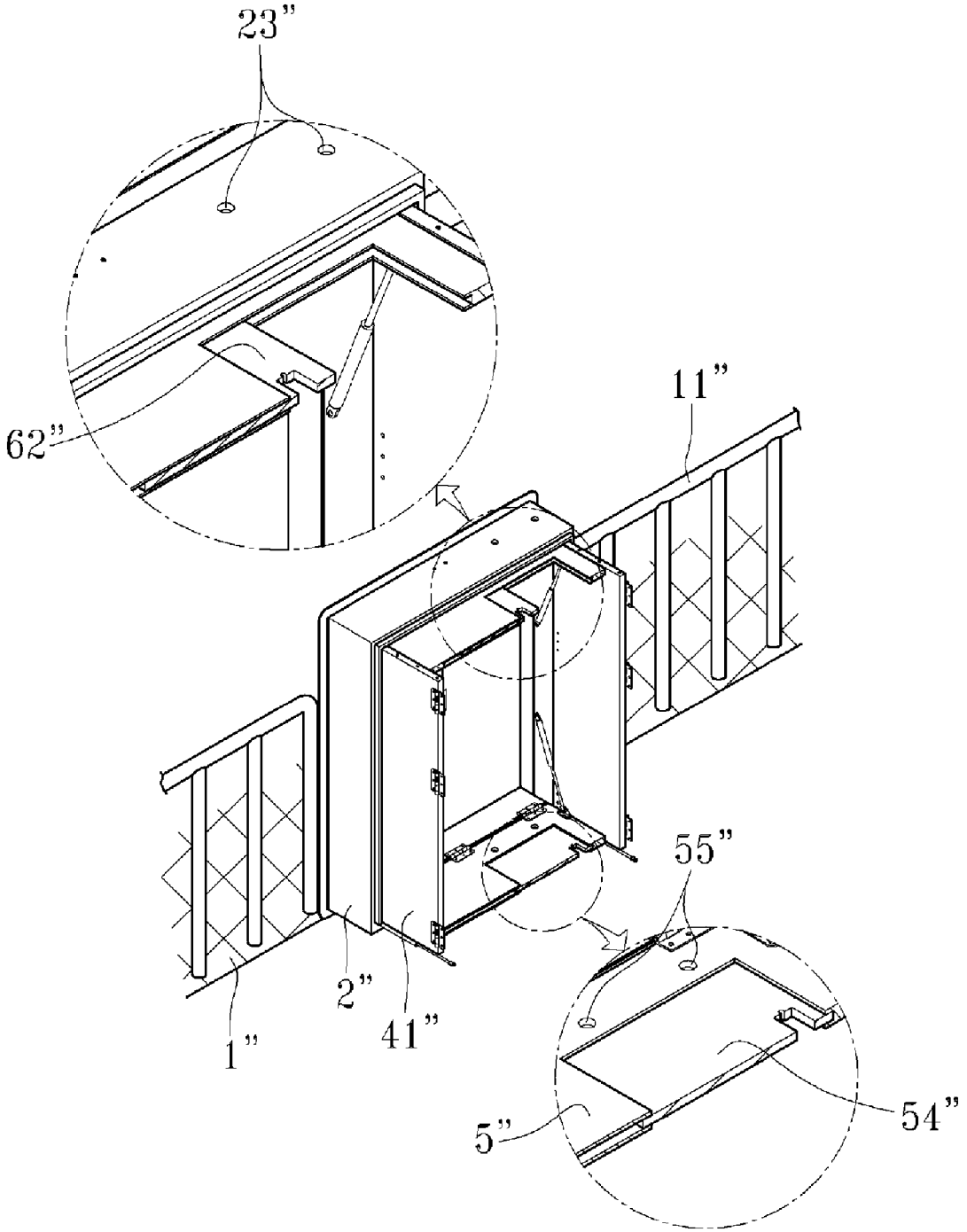
Figure 29C:
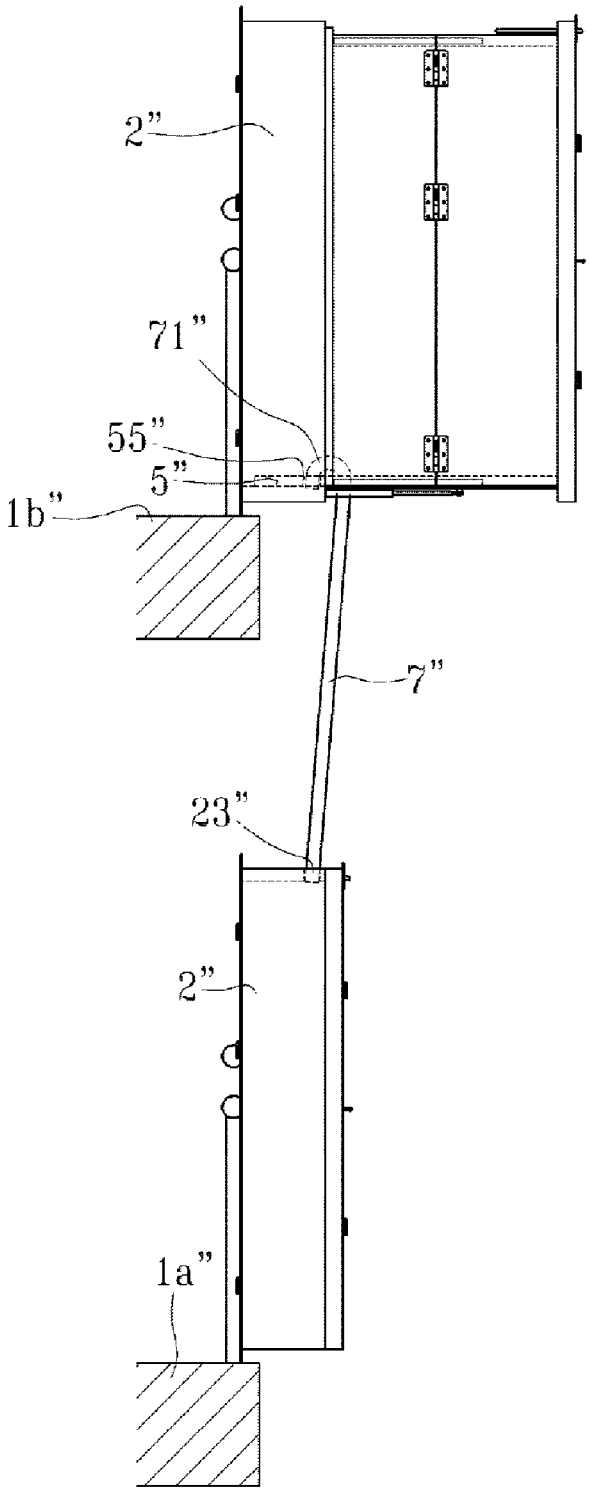
Figure 29D:
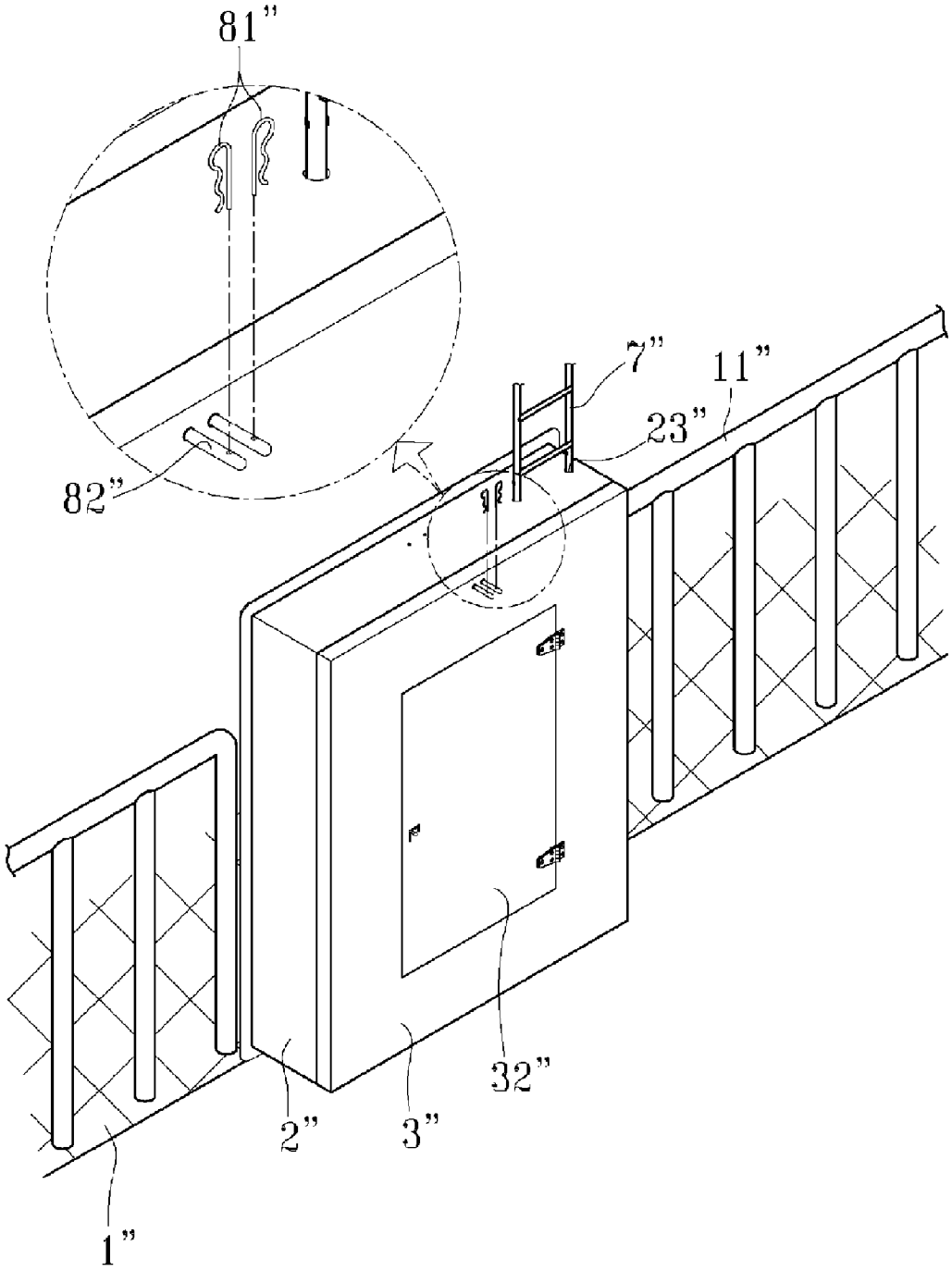
Figure 29E:
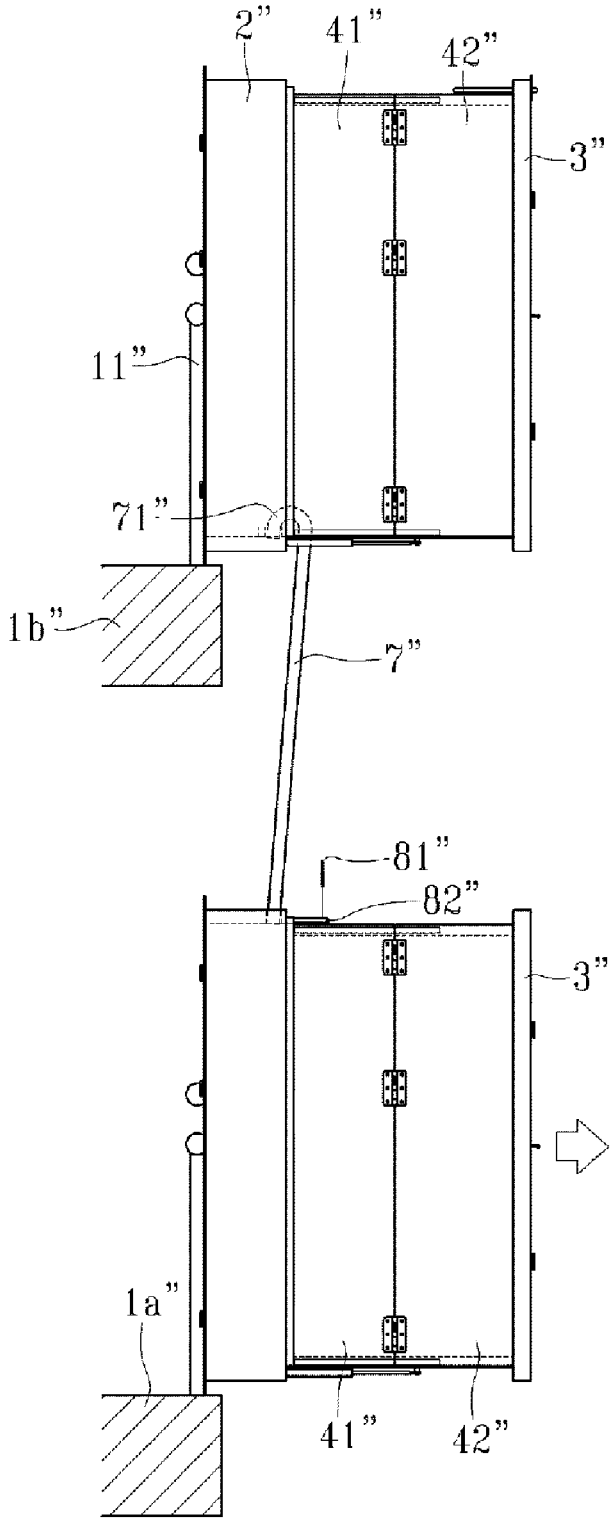

FIGS. 28*b* and 28*a* are conceptual diagrams illustrating a process by collapsing the emergency evacuation installation according to the present embodiment which further includes at least one second wire 92" having distal ends attached to upper portions of the first side panels 41" near the second side panels 42" and at least one proximal end which extends to the inner upper central portion of the frame 2", passes through a least one opening 91" of the frame 2" and then drape down. Also included is a pull handle 93" attached to the free end of the second wire 92".

This embodiment addresses the considerable difficulty of refolding the installation after use and eliminates the risk of falling of a user in the process. Specifically, folding the side panels 4" by the pull handle 93" will force the top panel 6" and bottom panel 5" into the collapsed positions, and a further pulling brings the locking member 82" of the locking means 8" to enter the locking groove 83", when the hook 85" of the rotational link 87" keeps the locking member 82" into the latched position.

FIGS. 29*a* to 29*e* are conceptual diagrams for illustrating a process of using the present emergency evacuation installation as an elevation means according to the present embodiment. With a series of such emergency evacuation installations provided up and down on veranda 1*a*" and veranda 1*b*" (located above veranda 1*a*") for example, if fire breaks out leaving downstairs less damaged from flame or toxic gas with incapacitated emergency exit and other means of access, the occupants upstairs can first deploy their own evacuation installation to open the lower sliding door 54" of the bottom panel 5", insert the upper hooks 71" of the emergency ladder 7" in the second ladder fixture holes 55", and links the ladder 7" by inserting its foots into the first ladder docking holes 23" of the downstairs emergency evacuation installation. Then, the evacuees can proceed to downstairs to find better routes to evacuate the building.

As the evacuees find no appropriate means of evacuation downstairs, they can decide to use the downstairs installation while descending by pulling out the locking pins 81" of the locking member 82" to deploy the installation and entering there through the upper sliding door 62" of the top panel 6', which can be repeated down to the ground.

The invention claimed is:

1. An emergency evacuation installation, comprising:

a rectangular frame (2) configured to be fixed to a veranda (1) and comprising an entrance (21) at a front side;

a rear panel (3) disposed at a rear of the frame (2) and comprising an exit door (31), two side panels (4), a bottom panel (5), and a top panel (6), which jointly constitute a collapsible box-shaped emergency escape shelter;

a front cover (7) configured to tightly surround the rectangular frame (2) and extending to the rear of the frame (2) and terminating at a first press-fit flange (71) which is bent inwardly at right angle; and a rear cover (8) comprising a main body configured to be fixed to a rear surface of the rear panel (3) and an opening formed not to interfere with the opening and closing of the exit door (31) and outer edges extending forward from the main body at right angle, wherein the main body terminates at a second press-fit flange (82) from another inward right-angle bending so that the second flange (82) abuts the first flange (71) as the evacuation installation is fully collapsed.

2. The emergency evacuation installation of claim 1, further comprising:

a flame deflector (72) gradually enlarging four side walls of the front cover (7) in a slant rearward and then reducing into a stepped end.

3. The emergency evacuation installation of claim 1, wherein one of the first and second press-fit flanges (71, 82) extends further inward in a first direction past the other and bends perpendicular to the first direction toward the other along a smaller extension and then bends again parallel to and opposite the first direction to additionally form a draining section (83).

4. The emergency evacuation installation of claim 1, further comprising:

sealing mounting ribs (73) which are disposed adjacent to rear ends of the front cover (7) and extend by branching inwardly followed by rearward extensions to jointly form grooves along a rear boundary line of the front cover (7);

coupling ribs (84) which extend at right angle from front ends of the rear cover (8) and bend again forwardly to be distally inserted in the grooves of the sealing mounting ribs (73); and a sealing member (9) formed as a rectangular ring with a corresponding groove along the rear ends of the front cover (7).

5. An emergency evacuation installation collapsed to be of a box shape and readily deployed for accommodating a plurality of occupants safely in emergency situations such as fires, the emergency evacuation installation comprising:

a rectangular frame (2') configured to be fixed to a veranda (1') and comprising hinged double doors (22') and wherein each door has a knob (21') projecting forward;

a rear panel (3') being disposed rearward of the frame (2') and comprising a rectangular shaped body, an exit door, a bottom flange (31') and a top flange (32'), and wherein the bottom flange and the top flange extend forward at right angles from bottom and top ends of the body, respectively, and wherein the exit door (33') is located centrally in the body of the rear panel (3') so that the rear panel (3') is externally accessed for an evacuation;

two side panels (4') wherein each side panel includes a first and a second panel (41' and 42') which are bisected vertically and interconnected in a foldable arrangement by one or more first hinges (43'), each side panel (4') being also connected at its front and rear ends by one or more second and third hinges (44', 45') foldably with a rear portion of the inside of the frame (2') and one lateral end of the rear panel (3'), respectively;

a bottom panel (5') having a lateral end attached to one or more fourth hinges (51') formed inside of a lower end portion of the frame (2') and at least one air inlet hole 52' with a closing and opening plate (53') adjustably disposed thereover so that the bottom panel (5') is dropped until stopped by the bottom flange (31') of the rear panel (3') to complete the floor surface as the emergency evacuation installation is deployed;

a top panel (6') having a lateral end attached to one or more fifth hinges (61') formed inside of an upper end portion of the frame (2') and engaging, when deployed, a bottom surface of the top flange (32') of the rear panel (3'); and an activation bar (7') which is elongated and has one end fixed to an upper surface of the top flange (32') of the rear panel (3') and an opposite end passing through a guide hole (23') formed in the frame (2') and terminating by a handle portion (71'), the activation bar (7') being divided into two sections articulated by a hinge (72') placed so that the hinge (72') passes through the guide hole (23') with all the panels collapsed and then bends vertically downwards to rest.

6. The emergency evacuation installation of claim 5, further comprising:

a hydraulic cylinder (24') having one end fixed to an interior portion of the frame (2') and the opposite end fixed to the top panel (6') to urge the top panel (6') in the direction of deployment.

7. The emergency evacuation installation of claim 5, further comprising:

two or more ball casters (54') additionally installed on opposite sides of the bottom panel (5') where close lateral contacts are made with the side panels (4') to minimize frictions therebetween.

8. The emergency evacuation installation of claim 5, further comprising:

a key plate (8') having bottom grooves (81') for receiving insertions of both knobs (21') when the activation bar (7') normally lays flat between the double doors 22' to fasten the activation bar (7') and the double entrance doors (22') together.

9. The emergency evacuation installation of claim 5, further comprising:

wires (25') each having one end attached to an upper portion of the frame (2') and the other end attached to the bottom panel (5') at either lateral end near contacts thereof with the lower flange (31') of the rear panel (3'), and the length of the wire (25') being determined to permit the bottom panel (5') to unfold up to a horizontal limit; and a wire guide (46') is formed as an elongated tube installed in the first side panel (4') coupled to the frame (2') for the wire (25') to run therethrough, the wire guide 46' being installed in a corresponding orientation to the wire (25') when activated with the bottom panel (5') expanded.

10. The emergency evacuation installation of claim 5, further comprising:

a heat insulating material (9') installed on the outer surfaces of the respective panels (2',3',4',5',6').

11. An emergency evacuation installation configured to be attached to a veranda (1") collapsed to be of a box shape and readily deployed for accommodating a plurality of occupants safely in emergency situations such as fires, the emergency evacuation installation comprising:

a rectangular frame (2") configured to be fixed to the veranda (1") and comprising hinged double entrance doors (22") and wherein each door has a knob (21") projecting forward and a pair of first ladder docking holes (23") extending vertically through the frame (2") and opening towards the upper surface of the frame (2");

a rear panel (3") being disposed rearward of the frame (2") and comprising a rectangular shaped body, an exit door and a flange (31") extending forward at right angle of the periphery of the body of the rear panel (3") and wherein the exit door (32") is located centrally in the body of the rear panel (3");

a pair of side panels (4") each including a first and a second panel (41" and 42") which are interconnected in an inwardly folding arrangement by one or more corresponding first hinges (43") and each side panel (4") being also connected at its front and rear ends by one or more second and third hinges (44", 45") foldably with the rear portion of the inside of the frame (2") and one lateral end of the rear panel (3"), respectively;

a bottom panel (5") having a lateral end attached to one or more fourth hinges (51") formed inside of a lower end portion of the frame (2"), at least one air inlet hole (52") with a closing and opening plate (53") adjustably disposed thereover, a lower sliding door (54") configured to be pushed sideways to slide open a predetermined portion of the bottom panel (5"), and a pair of second ladder fixture holes (55") extending through the bottom panel (5") and located between the lower sliding door (54") and the double entrance doors (22") so that the bottom panel (5") is expanded until stopped by a lower section of the flange (31") of the rear panel (3") to complete the floor surface as the emergency evacuation installation is deployed;

a top panel 6' having a lateral end attached to one or more fifth hinges (61") formed inside of an upper end portion of the frame (2") and an upper sliding door (62") configured to be pushed sideways to slide open a predetermined portion of the top panel (6"), and engages, when deployed, a downward surface of an upper section of the flange (31"); and an emergency ladder (7") installed inside of one of the double entrance doors (22") and having upper hooks (71") each bent into a forward curve terminated by a distal end which can be inserted in each of the second ladder fixture holes (55") and feet which can be inserted in another pair of first ladder docking holes (23") of a downstairs emergency evacuation installation once the emergency evacuation installation is repeatedly attached in a column over the building.

12. The emergency evacuation installation of claim 11, further comprising:

a first pair of hydraulic cylinders (24") fixed at first ends to the interior of the frame (2") with the opposite ends being fixed to the top panel (6") to thrust the top panel (6") in the intended direction of deployment;

a second pair of hydraulic cylinders (25") fixed at first ends to the interior of the frame (2") with the opposite ends being fixed to the bottom panel (5") to thrust the bottom panel (5") in the intended direction of deployment; and a third pair of hydraulic cylinders (26") fixed at first proximal ends to a lower rear portion of the frame (2") with the opposite ends being fixed to the second side panels (42") to thrust the first and second side panels (41", 42") in their intended direction of deployment.

13. The emergency evacuation installation of claim 11, further comprising:

torsion springs (46") mounted on rotation axes of the first hinges (43") for interconnecting the first and second side panels (41" and 42") to urge the first and second side panels towards their intended positions of deployment.

14. The emergency evacuation installation of claim 11, further comprising:

a gasket 27" fitted on a contact surface between the entrance doors (22") and the frame (2") for preventing harmful gas and smoke from entering the interior of the emergency evacuation installation through a clearance about the doors (22").

15. The emergency evacuation installation of claim 11, further comprising:

a locking member (82") formed as a U-hook with two arms penetrating the rear panel (3") from its front upper portion rearward and secured in place with a pair of locking pins (81") pressed into holes formed distally of the two arms;

a locking bracket (84") attached to a top inner portion of the frame (2") and having a locking groove (83") for accepting an insertion of the front end of the locking member (82");

a rotational link (87") rotatably mounted on the locking bracket (84") and having one end provided with a hook (85") for responsively latching the locking member (82") as entering the locking groove (83") and the opposite end provided with a wire connecting portion (86"); and a first wire (89") connected at one end to the wire connecting portion (86") of the rotational link (87") and is guided up and then draped down terminating with a release knob (88").

16. The emergency evacuation installation of claim 11, further comprising:

at least one second wire (92") having distal ends attached to upper portions of the first side panels (41") near the second side panels (42") and at least one proximal end which extends to the inner upper central portion of the frame (2"), passes through a least one opening (91") of the frame 2" and then drape down; and a pull handle (93") attached to a free end of the second wire (92").

17. The emergency evacuation installation of claim 2, wherein one of the first and second press-fit flanges (71, 82) extends further inward and bends right toward the other along a smaller extension and then bends again perpendicularly and outwardly to additionally form a draining section (83).

18. The emergency evacuation installation of claim 2, further comprising:

sealing mounting ribs (73) which are disposed adjacent to rear ends of the front cover (7) and extend by branching inwardly followed by rearward extensions to jointly form grooves along a rear boundary line of the front cover (7);

coupling ribs (84) which extend at right angle from front ends of the rear cover (8) and bend again forwardly to be distally inserted in the grooves of the sealing mounting ribs (73); and a sealing member (9) formed as a rectangular ring with a corresponding groove along the rear ends of the front cover (7).

19. The emergency evacuation installation of claim 6, further comprising:

a heat insulating material (9') installed on the outer surfaces of the respective panels (2',3',4',5',6').

20. The emergency evacuation installation of claim 7, further comprising:

a heat insulating material (9') installed on the outer surfaces of the respective panels (2',3',4',5',6').

21. The emergency evacuation installation of claim 8, further comprising:

a heat insulating material (9') installed on the outer surfaces of the respective panels (2',3',4',5',6').

22. The emergency evacuation installation of claim 9, further comprising:

a heat insulating material (9') installed on the outer surfaces of the respective panels (2',3',4',5',6').

23. The emergency evacuation installation of claim 12, further comprising:

torsion springs (46") mounted on rotation axes of the first hinges (43") for interconnecting the first and second side panels (41" and 42") to urge the first and second side panels towards their intended positions of deployment.

* * * * *